US008678038B2

(12) United States Patent
Adachi

(10) Patent No.: US 8,678,038 B2
(45) Date of Patent: Mar. 25, 2014

(54) EXHAUST SYSTEM, A SADDLE RIDING TYPE VEHICLE HAVING THE SAME, AND A METHOD OF MANUFACTURING AND MOUNTING AN EXHAUST PIPE

(75) Inventor: Makoto Adachi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 785 days.

(21) Appl. No.: 12/859,848

(22) Filed: Aug. 20, 2010

(65) Prior Publication Data

US 2011/0047998 A1 Mar. 3, 2011

(30) Foreign Application Priority Data

Sep. 2, 2009 (JP) ..... 2009-202642

(51) Int. Cl.
*F16L 11/00* (2006.01)

(52) U.S. Cl.
USPC ..... 138/109; 138/114; 138/178; 181/228; 181/238; 181/249; 29/890.08

(58) Field of Classification Search
USPC ..... 138/114, 178, 109; 181/228, 238, 269, 181/249, 252; 60/324, 276, 322; 29/890.08
See application file for complete search history.

(56) References Cited

U.S. PATENT DOCUMENTS 390,438 A * 10/1888 Bradbeer ..... 285/123.16
3,206,836 A * 9/1965 Schlussler ..... 29/890.08
3,904,374 A * 9/1975 Rosenlund ..... 422/168
5,832,723 A * 11/1998 Iwata et al. ..... 60/276
6,648,099 B2 * 11/2003 Dooley ..... 181/228

FOREIGN PATENT DOCUMENTS

| | | | |
|---|---|---|---|
| EP | 0 722 040 | A2 | 7/1996 |
| EP | 919704 | A1 * | 6/1999 |
| JP | 60-150417 | A | 8/1985 |
| JP | 10-52721 | A | 2/1998 |
| JP | 11-257072 | A | 9/1999 |
| JP | 2002-332838 | A | 11/2002 |
| JP | 2006112369 | A * | 4/2006 |
| WO | 2006/029201 | A1 | 3/2006 |

OTHER PUBLICATIONS

Official Communication issued in corresponding European Patent Application No. 10172745.1, mailed on Dec. 8, 2010.

* cited by examiner

*Primary Examiner* — Patrick F Brinson
(74) *Attorney, Agent, or Firm* — Keating & Bennett, LLP

(57) ABSTRACT

An exhaust system includes an exhaust pipe. The exhaust pipe includes an outer pipe and an inner pipe. A first through-hole and a second through-hole are provided in a peripheral surface of the outer pipe and a peripheral surface of the inner pipe, respectively, to receive an exhaust gas detector. Third through-holes are provided in the peripheral surface of the outer pipe, at a different position than that of the first through-hole. Since the third through-holes are provided in the outer pipe, a liquid can be drained promptly from a space between the outer pipe and inner pipe. Exhaust gas can be prevented from being discharged to the atmosphere by sealing the third through-holes.

14 Claims, 14 Drawing Sheets

EXHAUST SYSTEM, A SADDLE RIDING TYPE VEHICLE HAVING THE SAME, AND A METHOD OF MANUFACTURING AND MOUNTING AN EXHAUST PIPE

BACKGROUND OF THE INVENTION

1. Field of the Invention

The present invention relates to an engine exhaust pipe, an engine exhaust system, and a saddle riding type vehicle including an exhaust system and exhaust pipe, and a method of manufacturing and mounting an engine exhaust pipe, and more particularly relates to a technique of preventing exhaust gas from leaking from an exhaust pipe, without lowering productivity of the exhaust pipe.

2. Description of the Related Art

With a saddle riding type vehicle represented by a two-wheeled motor vehicle and the like, an engine exhaust pipe may be visible as part of its outward appearance. Therefore, the outward appearance may be improved by applying surface treatment such as chrome plating to the exhaust pipe. In this case, the exhaust pipe can be made into a hollow double structure having an outer pipe and an inner pipe, to prevent the surface of the outer pipe from discoloring due to the temperature of exhaust gas, thereby to maintain the outward appearance (see Japanese Unexamined Patent Publication H11-257072 and Japanese Unexamined Patent Publication No. 2002-332838, for example).

Japanese Unexamined Patent Publication No. 2002-332838 describes that, when applying chrome plating to the exhaust pipe in the form of a double pipe, the outer pipe and inner pipe are welded to seal a space between the outer pipe and inner pipe.

However, the conventional example with such construction has the following problem.

That is, with the conventional apparatus, when surface treatment is carried out in a state where the space between the outer pipe and inner pipe is not sealed, a treating liquid for the surface treatment such as plating liquid will flow into the space between the outer pipe and inner pipe. In this case, it takes time to drain the treating liquid from this space, which will lower productivity. The treating liquid remaining in this space will cause corrosion of the exhaust pipe.

Therefore, it is known to form drain holes in a peripheral surface of the outer pipe. This measure allows the treating liquid for the surface treatment to be drained promptly, and the surface treatment to be carried out efficiently. With these drain holes, instead of being limited to the surface treatment, it is possible to drain a liquid promptly, such as water filled and frozen in the space between the outer pipe and inner pipe at a time of bending a multiple pipe. After attaching the exhaust pipe to a saddle riding type vehicle, ambient air can flow into and out of the space between the outer pipe and inner pipe through the drain holes, thereby cooling the exhaust pipe effectively. When the drain holes are formed in a peripheral surface of the inner pipe, the space between the outer pipe and inner pipe will be added to the capacity of the exhaust passage, which renders engine output characteristics different from what has been intended. It is therefore preferable to form the drain holes in a peripheral surface of the outer pipe.

When an exhaust gas detector such as an oxygen sensor, or a branch piping member such as piping which introduces secondary air into the exhaust pipe (hereinafter referred to as "sensor or the like"), is attached to the exhaust pipe, through-holes are formed in the outer pipe and inner pipe, respectively, and the sensor or the like is inserted from outside the outer pipe into the inner pipe. At this time, in the case of the oxygen sensor, by welding to the outer pipe a boss for attaching the oxygen sensor, for example, the sensor or the like can be made to penetrate the outer pipe in a gas-tight state. However, it is difficult to make the sensor or the like penetrate the inner pipe in a gas-tight state. There is a possibility that exhaust gas flowing within the inner pipe flows into the space between the inner pipe and outer pipe. Thus, there is a possibility that exhaust gas leaks from the exhaust pipe to the atmosphere when drain holes are formed in the outer pipe as in the prior art. When attaching the sensor or the like to the exhaust pipe, exhaust holes cannot be formed as in the prior art. As a result, it becomes difficult to drain the above-noted treating liquid promptly, and hence an inconvenience of lowering productivity of the exhaust pipe occurs.

SUMMARY OF THE INVENTION

In view of the state of the art noted above, preferred embodiments of the present invention provide an exhaust system, a saddle riding type vehicle including the same, and a method of manufacturing and mounting an exhaust pipe, which prevent exhaust gas from leaking from the exhaust pipe to the atmosphere, without lowering productivity of the exhaust pipe.

According to a preferred embodiment of the present invention, an exhaust system for exhaust gas discharged from an engine includes an exhaust pipe including an inner pipe arranged to guide the exhaust gas and an outer pipe mounted outside of the inner pipe; wherein a first through-hole is provided in a peripheral surface of the outer pipe to receive an insert member inserted from outside the outer pipe into the inner pipe; a second through-hole is provided in a peripheral surface of the inner pipe to receive the insert member; and third through-holes are further arranged in the peripheral surface of the outer pipe, in a different position than that of the first through-hole.

With the exhaust system according to this preferred embodiment of the present invention, the third through-holes are provided in the outer pipe. Therefore, a liquid can be drained promptly from a space between the outer pipe and inner pipe, thereby never lowering productivity of the exhaust pipe. By sealing the third through-holes, even if exhaust gas flows into the space between the outer pipe and inner pipe through the second through-hole, the exhaust gas is prevented from being discharged to the atmosphere.

In a preferred embodiment of the present invention, it is preferred that, when an exhaust system member is connected to the exhaust pipe, the third through-holes are arranged at a position in the exhaust system member. In other words, it is preferred that at least one end of the exhaust pipe is inserted in an exhaust system member connected to the exhaust pipe; and the third through-holes are arranged in a position covered by the exhaust system member when the exhaust system member is connected to the exhaust pipe. Since the third through-holes can be sealed solely by attaching the exhaust pipe to the exhaust system member, the working efficiency in installing the exhaust pipe is never lowered.

In a preferred embodiment of the present invention, it is preferred that the outer pipe includes a main body portion and a small diameter portion having a smaller outside diameter than the main body portion, the third through-holes being arranged in the small diameter portion. Since the third through-holes are provided in the small diameter portion, the third through-holes can be sealed conveniently.

In a preferred embodiment of the present invention, it is preferred that the outer pipe and the inner pipe are joined adjacent the third through-holes, to block a space between the outer pipe and the inner pipe. Since the third through-holes are provided at the end of the space between the outer pipe and inner pipe, a liquid can be drained efficiently from this space through the third through-holes.

In a preferred embodiment of the present invention, it is preferred that the inner pipe includes a main body portion and a large diameter portion having a larger diameter than the main body portion, the third through-holes being arranged in the peripheral surface of the outer pipe, in a position which overlaps the large diameter portion in a direction of a center axis of the outer pipe. Since the third through-holes are arranged at a position opposed to the large diameter portion of the inner pipe, it is possible, when the liquid is drained from the space between the outer pipe and inner pipe through the third through-holes, to prevent a portion of the liquid from remaining in this space.

In a preferred embodiment of the present invention, it is preferred that the system further includes a mounting member arranged to hold the insert member, wherein a gap between the mounting member and the outer pipe is sealed by welding. With the mounting member provided, the insert member can penetrate the outer pipe in a gas-tight state. This can conveniently prevent exhaust gas from being discharged to the atmosphere through the first through-hole.

In a preferred embodiment of the present invention, it is preferred that the system further includes a seal member arranged to seal the third through-holes. With the seal member provided to seal the third through-holes, even if exhaust gas flows into the space between the outer pipe and inner pipe through the second through-hole, the exhaust gas is prevented from being discharged to the atmosphere.

In a preferred embodiment of the present invention, it is preferred that the seal member has elasticity. The seal member can fit over the third through-holes to seal the third through-holes with increased reliability. It is further preferred that the seal member is an elastic body. It is also preferred that the seal member is elastically deformable.

In a preferred embodiment of the present invention, it is preferred that the seal member includes at least one of a gasket, ceramic fiber, glass fiber, a heat insulating material, or a heat-resistant resin. This realizes a seal member with excellent sealing performance.

In a preferred embodiment of the present invention, it is preferred that the system includes a fixing member arranged to fix the seal member, wherein the seal member is disposed on an outer surface of the outer pipe so as to cover the third through-holes. With the fixing member provided, the third through-holes can be sealed reliably without being influenced by vibration and the like.

In a preferred embodiment of the present invention, it is preferred that the fixing member presses the seal member on the outer surface of the outer pipe. The seal member can conveniently be placed in close contact with the third through-holes.

In a preferred embodiment of the present invention, it is preferred that the system further includes an exhaust system member connected to the exhaust pipe, with an end of the exhaust pipe inserted therein; wherein the exhaust system member includes a fitting portion arranged to receive the end of the exhaust pipe fitted therein; the third through-holes are arranged in a position fitted in the fitting portion; and the fitting portion is constructed to fix the seal member provided for the outer pipe inserted, to serve as the fixing member. The exhaust system member includes a fitting portion arranged to receive, as fitted therein, the end of the outer pipe including the third through-holes. Thus, the exhaust pipe can conveniently be connected to the exhaust system member. The fitting portion fixes the seal member provided for the outer pipe inserted. Thus, the fitting portion acts also as the fixing member. With such fitting portion provided, the exhaust system member and exhaust pipe can be connected simultaneously with fixation of the seal member, thereby never lowering the working efficiency in installing the exhaust pipe.

In a preferred embodiment of the present invention, it is preferred that the fixing member further includes a band member of a fitting portion arranged to tighten the fitting portion to press the seal member. With the band member of the fitting portion being provided, the seal member can be pressed on the outer surface of the outer pipe, thereby conveniently placing the seal member in close contact with the third through-holes.

According to yet another preferred embodiment of the present invention, a saddle riding type vehicle includes an exhaust pipe including an inner pipe arranged to guide exhaust gas discharged from an engine and an outer pipe mounted outside of the inner pipe; wherein a first through-hole is provided in a peripheral surface of the outer pipe to receive an insert member inserted from outside the outer pipe into the inner pipe; a second through-hole is provided in a peripheral surface of the inner pipe to receive the insert member; and third through-holes are further provided in the peripheral surface of the outer pipe, in a different position than that of the first through-hole.

With the saddle riding type vehicle according to various preferred embodiments of the present invention, exhaust gas is prevented from being discharged from the exhaust pipe to the atmosphere without lowering productivity of the exhaust pipe.

Here, the "saddle riding type vehicle" includes a motorcycle, an ATV (all-terrain vehicle) and a snowmobile. The motorcycle includes a scooter and a moped. The "saddle riding type vehicle" includes, besides a vehicle on which the rider is seated in a state like straddling a saddle, a vehicle driven by the rider seated with his or her legs close together.

A further preferred embodiment of the present invention provides a method of manufacturing and mounting an exhaust pipe for exhaust gas discharged from an engine, and including an inner pipe arranged to guide the exhaust gas and an outer pipe mounted outside of the inner pipe, the method including the steps of draining at least one of a treating liquid for surface treatment and a liquid filled and frozen at a time of a bending process being performed, from a space between the outer pipe and the inner pipe through drain holes formed at least one end of the outer pipe; and subsequently mounting the exhaust pipe in an exhaust system member while sealing the drain holes by inserting the end of the outer pipe including the drain holes in an opening of the exhaust system member connected to the exhaust pipe.

With the method of manufacturing and mounting an exhaust pipe according to a preferred embodiment of the present invention, the drain holes can be sealed by attaching the exhaust pipe to the exhaust system member after draining treating liquids for surface treatment and/or other liquid through the drain holes from the space between the outer pipe and inner pipe. Therefore, the working efficiency in installing of the exhaust pipe is never lowered. Moreover, even if exhaust gas flows into the space between the outer pipe and inner pipe, the exhaust gas can be prevented from being discharged to the atmosphere.

According to an additional preferred embodiment of the present invention, an exhaust system includes an exhaust pipe including a seal member arranged to seal the third through-holes. Since the exhaust pipe includes the seal member, the third through-holes can be sealed reliably.

The seal member preferably has elasticity thereby allowing the seal member to fit over the third through-holes to seal them with increased reliability.

Further, it is preferred that the seal member is an elastic body. For example, the seal member may preferably include at least one of a gasket, ceramic fiber, glass fiber, a heat insulating material and a heat-resistant resin. As a result, the seal member has excellent sealing performance.

The exhaust pipe may preferably include a fixing member to fix the seal member, and the seal member is preferably provided on the outer surface of the outer pipe so as to cover the third through-holes. Since the exhaust pipe includes a fixing member, the third through-holes can be sealed reliably without being influenced by vibration and the like.

The fixing member is preferably arranged to press the seal member on the outer surface of the outer pipe such that the seal member is conveniently placed in close contact with the third through-holes.

The fixing member is preferably defined by a band member of a seal portion tighten the seal member. As a result, the band member of the seal portion fixes the seal member in a state of conveniently being in close contact with the third through-holes.

The seal member is preferably inserted in the third through-holes such that the third through-holes are sealed with a simple construction.

The exhaust system member is preferably connected upstream of the exhaust pipe or downstream of the exhaust pipe such that the third through-holes are disposed at an end of the outer pipe.

The exhaust system member preferably is another exhaust pipe distinct from the exhaust pipe, a catalytic converter, a muffler or an engine. The exhaust pipe may be connected to various exhaust system members.

The seal member preferably is a metal plate-shaped object covering the third through-holes, and welded to the outer surface of the outer pipe in a gas-tight state so as to provide a strong seal member not influenced by vibration or shocks.

A bracket member is preferably provided to support the exhaust pipe, the bracket member including a reinforcing plate fixed to the outer surface of the outer pipe, the reinforcing plate being welded to the outer surface of the outer pipe in a gas-tight state so as to cover the third through-holes, thereby serving as the seal member. As a result, the third through-holes are sealed through an operation to attach the bracket member to the exhaust pipe. Thus, the working efficiency in installing the exhaust pipe is never lowered.

The exhaust pipe preferably includes a plurality of branch pipes provided for respective engine cylinders, and a collecting pipe which collects the branch pipes. The exhaust pipe is what is called a "manifold" including a collecting pipe which collects branch pipes. The exhaust pipe may also preferably include a plurality of upstream ends, for example, or a plurality of downstream ends.

The insert member preferably penetrates the outer pipe in a gas-tight state. Accordingly, exhaust gas is conveniently prevented from being discharged to the atmosphere through the first through-hole.

The exhaust pipe preferably includes a mounting member provided in the first through-hole, the mounting member allowing the insert member to penetrate the outer pipe in the gas-tight state.

Since the exhaust pipe includes the mounting member, the insert member can penetrate the outer pipe in the gas-tight state. Therefore, exhaust gas is conveniently prevented from being discharged to the atmosphere through the first through-hole.

The insert member is preferably directly attached to the outer pipe, to penetrate the outer pipe through the first through-hole in a gas-tight state. Since the insert member itself penetrates from inside and outside the outer pipe in a gas-tight state, exhaust gas can conveniently be prevented from being discharged to the atmosphere through the first through-hole.

The band member of the fitting portion preferably is disposed in a position corresponding to at least the third through-holes so that the seal member can reliably be placed in close contact with the third through-holes. More particularly, it is preferred that the band member of the fitting portion is disposed in a position overlapping the third through-holes with respect to the direction of the center axis of the outer pipe.

The system preferably further includes an exhaust system member connected to the exhaust pipe, with an end of the exhaust pipe inserted therein; and a seal member arranged to seal the third through-holes; wherein the third through-holes are arranged in a position inserted in the exhaust system member; the exhaust system member includes a fitting portion arranged to receive, fitted therein, the end of the exhaust pipe including the third through-holes; and the fitting portion is welded in a gas-tight state to the outer surface of the outer pipe inserted, to serve as the seal member.

As a result, the end of the outer pipe including the third through-holes is fitted in the fitting portion of the exhaust system member. Thus, the exhaust pipe can conveniently be connected to the exhaust system member. The fitting portion is welded in a gas-tight state to the outer surface of the outer pipe inserted. Thus, the fitting portion acts also as the seal member. With such fitting portion provided, the exhaust system member and exhaust pipe can be connected simultaneously during sealing of the third through-holes, thereby never lowering the working efficiency in installing the exhaust pipe. Further, the fitting portion fixed by welding can realize a strong seal member not influenced by vibration or shocks of connection.

The third through-holes have a function to drain a liquid from the space between the outer pipe and the inner pipe at a time of manufacturing the exhaust pipe, and are sealed after the liquid is drained. Thus, the liquid can be drained promptly from the space between the outer pipe and inner pipe at a manufacturing time, and thus productivity of the exhaust pipe is never lowered. The third through-holes are sealed after the liquid is drained. Thus, even if exhaust gas flows into the space between the outer pipe and inner pipe through an inner through-hole, the exhaust gas can be prevented from being discharged to the atmosphere.

An exhaust pipe for exhaust gas discharged from an engine, includes an inner pipe arranged to guide the exhaust gas and an outer pipe mounted outside of the inner pipe; wherein an inner through-hole communicating inside and outside of the inner pipe is provided in a peripheral surface of the inner pipe; and drain holes for draining a liquid from a space between the outer pipe and the inner pipe at a time of manufacturing the exhaust pipe, which drain holes are sealed after the liquid is drained, are provided in a peripheral surface of the outer pipe. Since the drain holes are provided in the outer pipe, the liquid can be drained promptly from the space between the outer pipe and inner pipe at a manufacturing time, and thus productivity of the exhaust pipe is never lowered. The drain holes are sealed after the liquid is drained. Thus, even if exhaust gas flows into the space between the outer pipe and inner pipe through the inner through-hole, the exhaust gas can be prevented from being discharged to the atmosphere.

An exhaust system for exhaust gas discharged from an engine, includes an exhaust pipe including an inner pipe arranged to guide the exhaust gas and an outer pipe mounted outside of the inner pipe; wherein an inner through-hole communicating inside and outside of the inner pipe is provided in a peripheral surface of the inner pipe; and drain holes for draining a liquid from a space between the outer pipe and the inner pipe at a time of manufacturing the exhaust pipe, which drain holes are sealed after the liquid is drained, are provided in a peripheral surface of the outer pipe; and a seal member is provided to seal the drain holes. Since the drain holes are provided in the outer pipe, the liquid can be drained promptly from the space between the outer pipe and inner pipe at a manufacturing time, and thus productivity of the exhaust pipe is never lowered. The seal member is provided to seal the drain holes after the liquid is drained. Thus, even if exhaust gas flows into the space between the outer pipe and inner pipe through the inner through-hole, the exhaust gas can be prevented from being discharged to the atmosphere.

These and other elements, features, steps, characteristics and advantages of the present invention will become more apparent from the following detailed description of the preferred embodiments with reference to the attached drawings.

BRIEF DESCRIPTION OF THE DRAWINGS

For the purpose of illustrating the invention, there are shown in the drawings several forms which are presently preferred, it being understood, however, that the present invention is not limited to the precise arrangement and instrumentalities shown.

DETAILED DESCRIPTION OF THE PREFERRED EMBODIMENTS

Preferred embodiments of the present invention will be described in detail hereinafter with reference to the drawings.

First Preferred Embodiment

Figure 1:
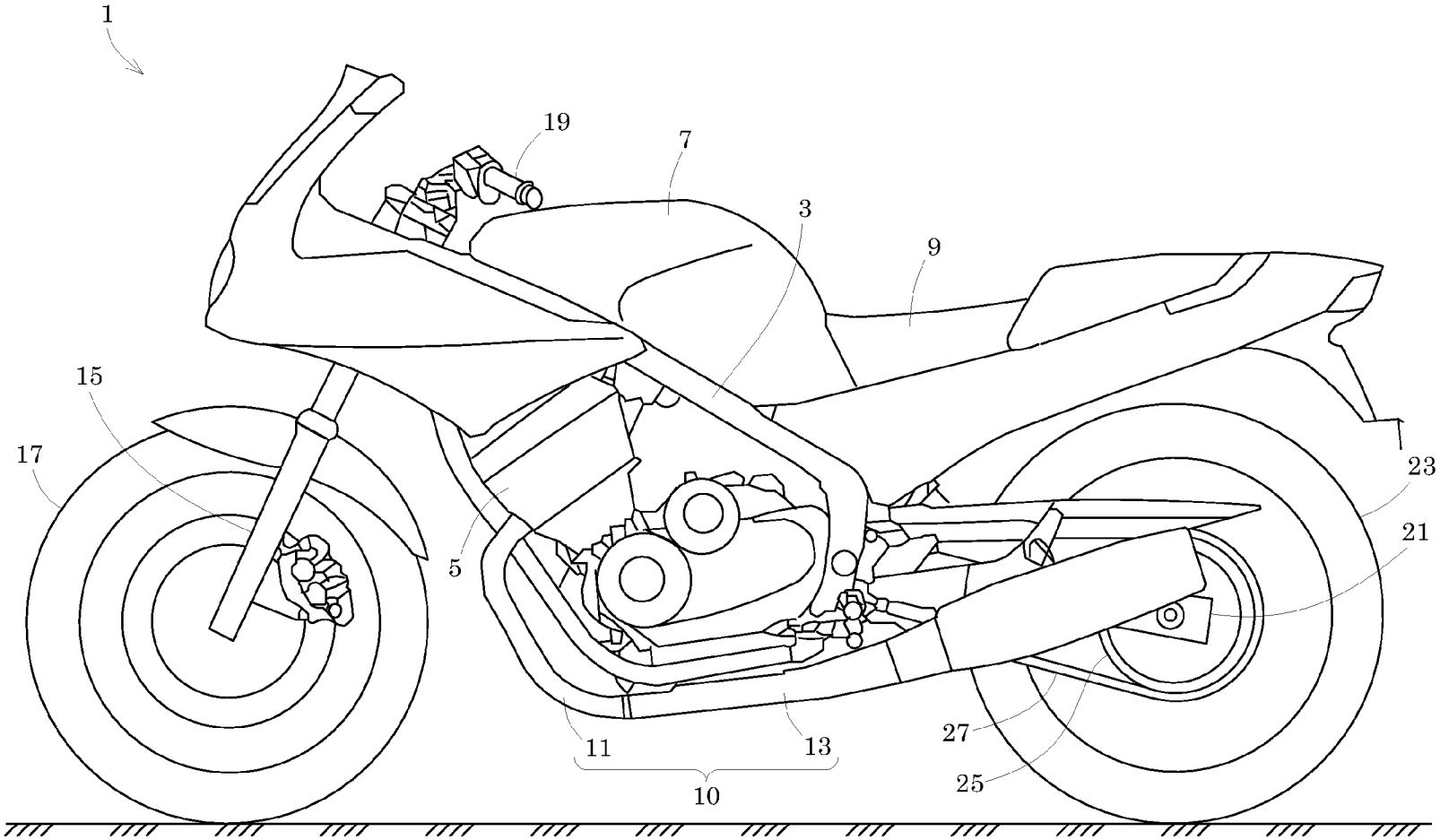
FIG. 1 is a side view showing an outline construction of a two-wheeled motor vehicle according to a preferred embodiment of the present invention.

FIG. 1 is a side view showing an outline construction of a two-wheeled motor vehicle according to a preferred embodiment of the present invention. In FIG. 1, the left of the drawing is the front of a two-wheeled motor vehicle 1.

The two-wheeled motor vehicle 1 includes a main frame 3. The main frame 3 has an engine 5, a fuel tank 7, a seat 9 and so on fixed thereto. The engine 5 is disposed in a lower portion of the main frame 3. The engine 5 has an exhaust pipe 11 connected thereto. A muffler 13 is connected downstream of the exhaust pipe 11. The exhaust pipe 11 and muffler 13 constitute an exhaust system 10 for exhaust gas discharged from the engine 5.

A steering shaft (not shown) is rotatably supported at an upper front end portion of the main frame 3. A front fork 15 is connected to a lower portion of the steering shaft. A front wheel 17 is rotatably supported by lower portions of the front fork 15. A handlebar 19 is connected to an upper portion of the steering shaft.

A swing arm 21 is swingably connected with to a lower rear end portion of the main frame 3. A rear wheel 23 is rotatably supported at a rear end of the swing arm 21. The rear wheel 23 has a driven sprocket 25 connected to be rotatable with the rear wheel 23. A chain 27 is wound on the driven sprocket 25. The chain 27 is wound also on a drive sprocket (not shown). Power generated by the engine 5 is transmitted to the rear wheel 23 through the drive sprocket, chain 27 and driven sprocket 25. Consequently, the two-wheeled motor vehicle 1 moves forward. The two-wheeled motor vehicle 1 corresponds to the saddle riding type vehicle in a preferred embodiment of the present invention.

Figure 2:
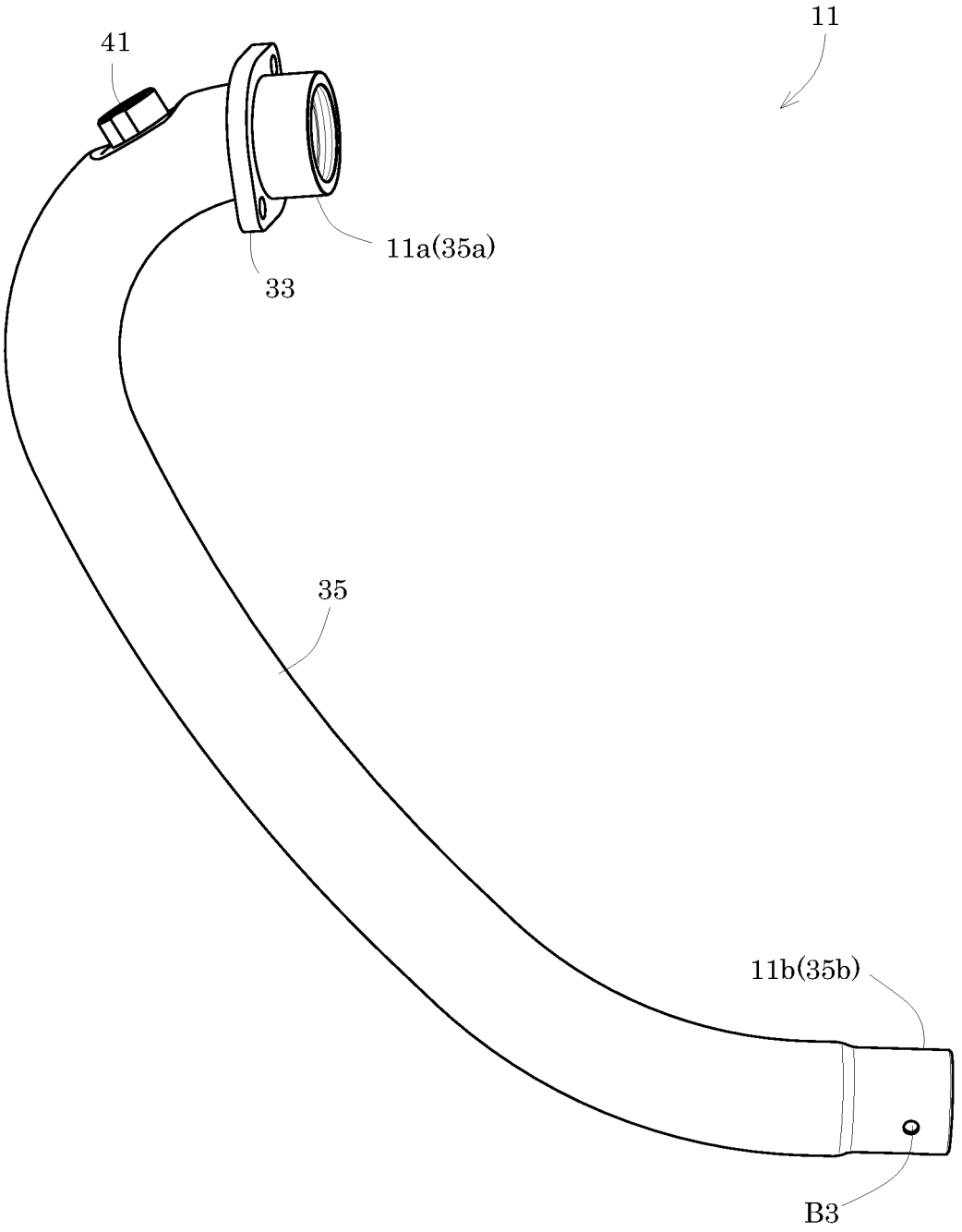
FIG. 2 is an appearance perspective view of an exhaust pipe.
Figure 3:
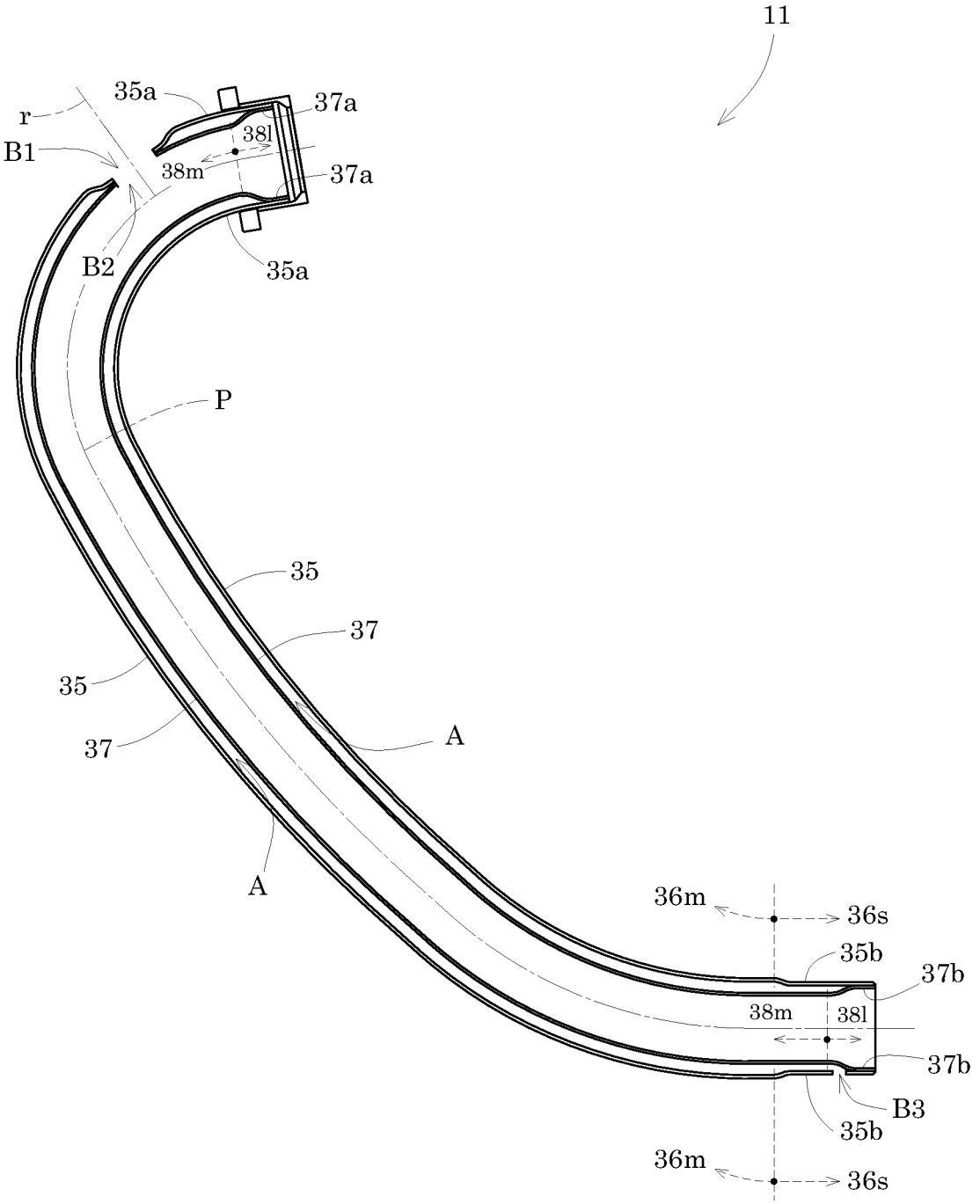
FIG. 3 is a sectional view of the exhaust pipe.

FIG. 2 is an appearance perspective view of the exhaust pipe, and FIG. 3 is a sectional view of the exhaust pipe. The exhaust pipe 11 assumes a curved shape as shown. An upstream end 11*a* of the exhaust pipe 11 is connected by a flange member 33 to the engine 5 noted above. A downstream end 11*b* of the exhaust pipe 11 is connected to the muffler 13 noted above.

As shown in FIG. 3, the exhaust pipe 11 preferably has a double structure including an outer pipe 35 and an inner pipe 37 mounted inside the outer pipe 35. The inner pipe 37 guides exhaust gas discharged from the engine 5. The outer pipe 35 is disposed outside the inner pipe 37. The outer pipe 35 is disposed at an outermost side, and is visible as outward appearance of the exhaust pipe 11 as shown in FIG. 2.

The inner pipe 37 is curved substantially similar to the outer pipe 35 and spaced a slight distance from the outer pipe 35. A space A is formed between these inner pipe 37 and outer pipe 35. An upstream end 35*a* of the outer pipe 35 and an upstream end 37*a* of the inner pipe 37 are joined together, while a downstream end 35*b* of the outer pipe 35 and a downstream end 37*b* of the inner pipe 37 are also joined together. Consequently, the space A is blocked at the opposite ends 11*a*, 11*b* of the exhaust pipe 11.

The outer pipe 35 is divided, by outside diameter, into a main body portion 36*m*, and a small diameter portion 36*s* having a smaller diameter than the main body portion 36*m*. The end 35*b* of the outer pipe 35 serves as the small diameter portion 36*s*. The region other than the end 35*b* of the outer pipe 35 (the region upstream of the end 35*b* of the outer pipe 35) serves as the main body portion 36*m*. The outer pipe 35 is slightly depressed around a first through-hole B1 to be described hereinafter.

Similarly, the inner pipe 37 is divided, by outside diameter, into a main body portion 38*m*, and large diameter portions 381 having a larger diameter than the main body portion 38*m*.

The opposite ends 37*a*, 37*b* of the inner pipe 37 serve as the large diameter portions 381. The other region of the inner pipe 37 (the region present between the end 37*a* and end 37*b* of the inner pipe 37) serves as the main body portion 38*m*.

An appropriate metal material is selected as the material of the outer pipe 35 and inner pipe 37. It may be iron, stainless steel, titanium or aluminum, for example. Each of the outer pipe 35 and inner pipe 37 may be realized by a two-layer structure.

Figure 10:
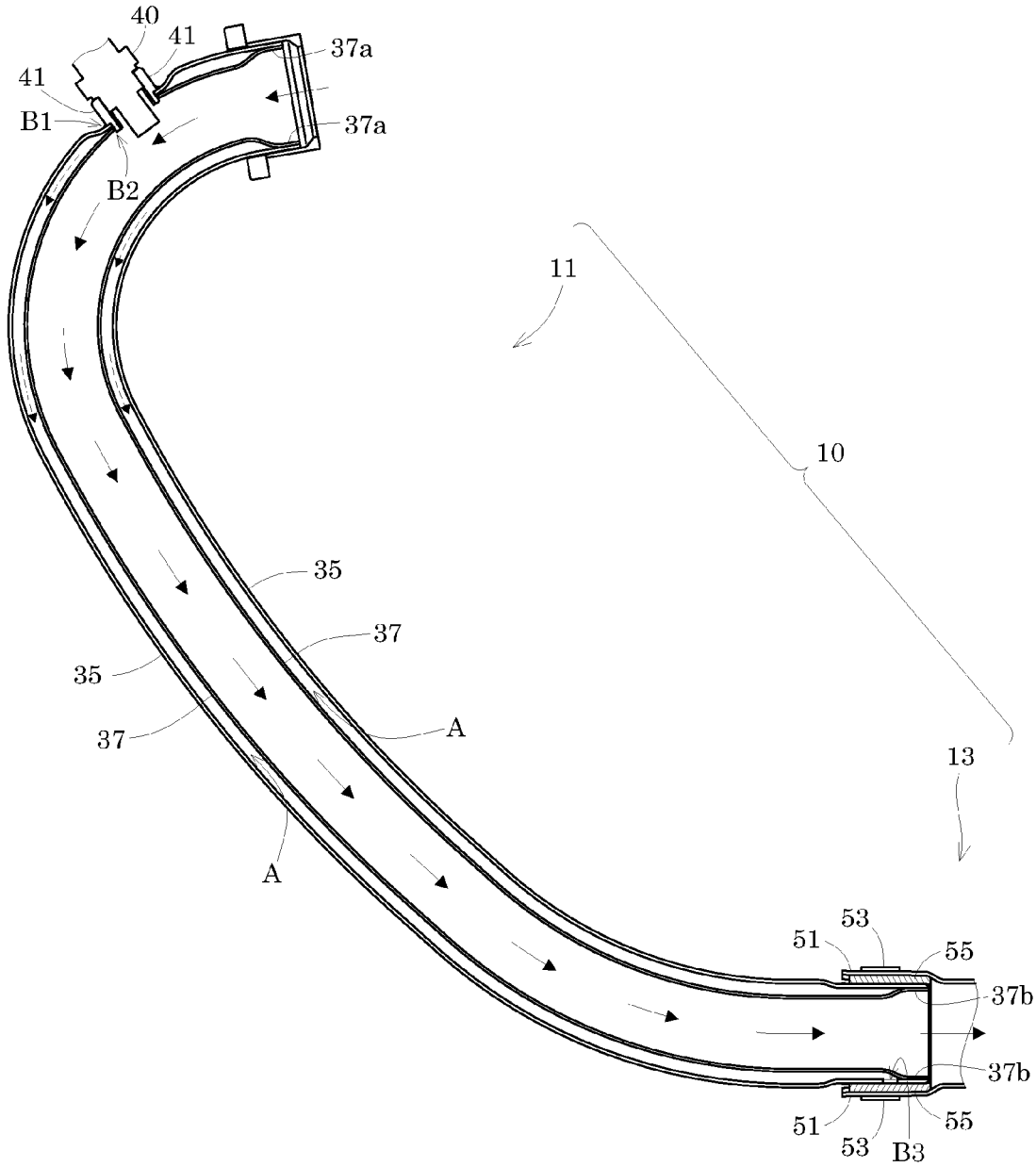
FIG. 10 is a sectional view of an exhaust system schematically showing a flowing direction of exhaust gas.

The first through-hole B1 and a second through-hole B2 are formed in a peripheral surface of the outer pipe 35 and a peripheral surface of the inner pipe 37, respectively, for inserting an exhaust gas detector 40 (see FIG. 10). The second through-hole B2 is formed in a position corresponding to the first through-hole B1. More particularly, the first through-hole B1 and second through-hole B2 are arranged, respectively, on one axis r in a radial direction of a central axis P of the exhaust pipe 11. The second through-hole B-2 corresponds to the second through-hole, and corresponds also to the inner through-hole of a preferred embodiment of the present invention.

The exhaust gas detector 40 is selected and designed as appropriate according to use and purpose. It may, for example, be an oxygen sensor arranged to detect an oxygen concentration in the exhaust gas, an A/F sensor or linear A/F sensor arranged to detect an air-fuel ratio, a knock sensor arranged to detect a high frequency vibration generated by knocking, a CO sensor arranged to measure a concentration of carbon monoxide in the exhaust gas, an HC sensor arranged to measure a concentration of hydrocarbon in the exhaust gas, or a temperature sensor arranged to detect temperature of the exhaust gas. The exhaust gas detector 40 corresponds to the insert member according to a preferred embodiment the present invention.

Reference is made to FIG. 2. A boss member 41 is provided in the first through-hole B1 to attach the exhaust gas detector 40. The boss member 41 is inserted in the first through-hole B1 and second through-hole B2.

Figure 4:
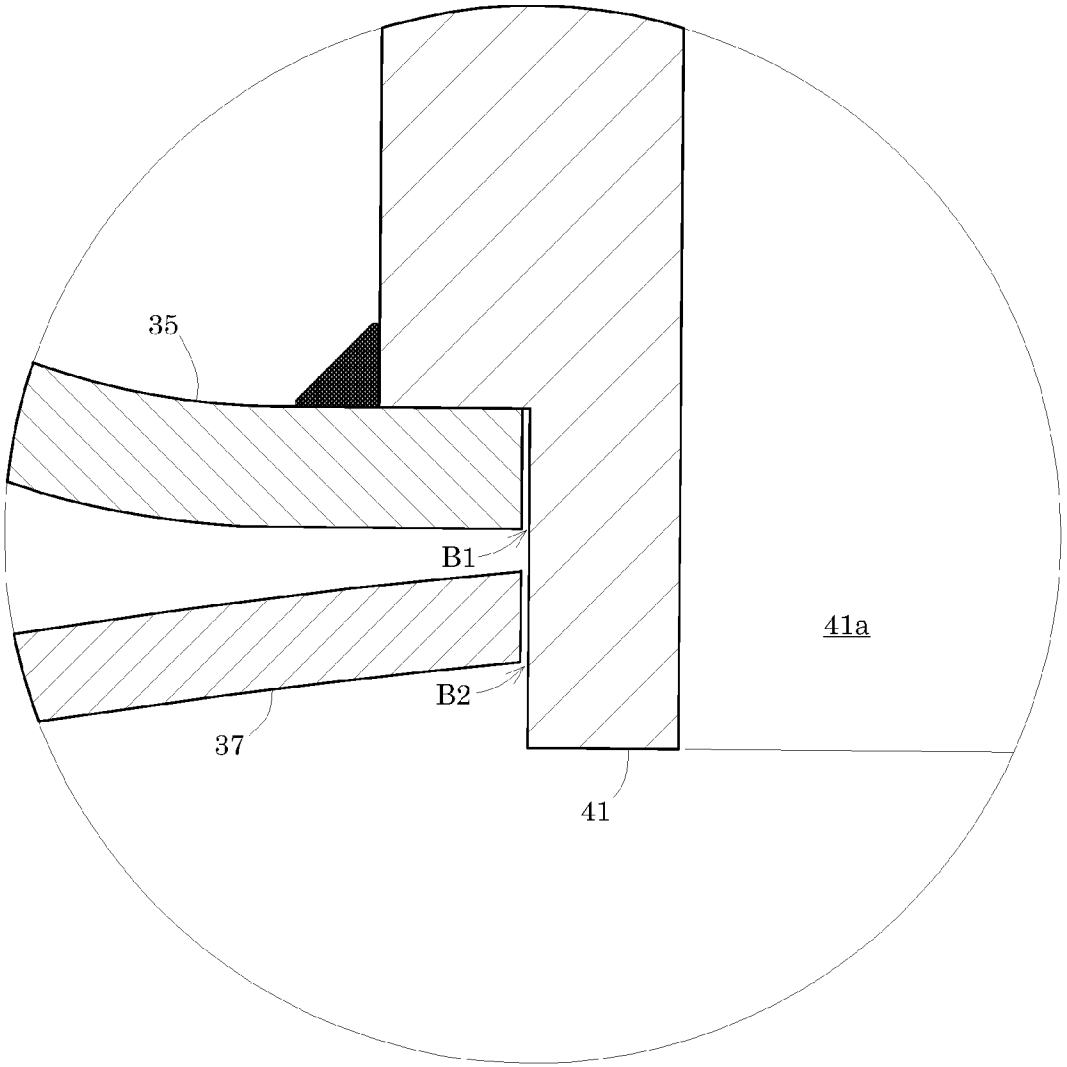
FIG. 4 is a detailed sectional view of a boss member, a first through-hole and a second through-hole.

Reference is made to FIG. 4. FIG. 4 is a detailed sectional view of the boss member, first through-hole and second through-hole. The boss member 41 is fixed to the outer pipe 35 by welding, for example. The welding is carried out over an entire outer periphery of the boss member 41. This seals a gap between the boss member 41 and outer pipe 35 (more particularly, a gap between the outer periphery of the boss member 41 and the edge of the first through-hole B1). The boss member 41 supports the exhaust gas detector 40 in its interior 41*a* to be gas-tight without a gap, and inserts a forward end of the exhaust gas detector 40 from outside the outer pipe 35 into the inner pipe 37. Consequently, the exhaust gas detector 40 penetrates the outer pipe 35 in a gas-tight state.

However, as seen from FIG. 4, welding of the boss member 41 and inner pipe 37 is difficult, and a gap between the boss member 41 and inner pipe 37 (more particularly, a gap between the outer periphery of the boss member 41 and the edge of the second through-hole B2) cannot be sealed. Therefore, the interior and the exterior of the inner pipe 37 are in communication through the second through-hole B2. The boss member 41 corresponds to the mounting member according to a preferred embodiment of the present invention.

As shown in FIGS. 2 and 3, the peripheral surface of the outer pipe 35 further includes third through-holes B3 arranged at different positions to the first through-hole B1. The third through-holes B3 are arranged at the downstream end 35*b* of the outer pipe 35. As noted hereinbefore, the end 35*b* of the outer pipe 35 serves as the small diameter portion 36*s*.

Figure 5:
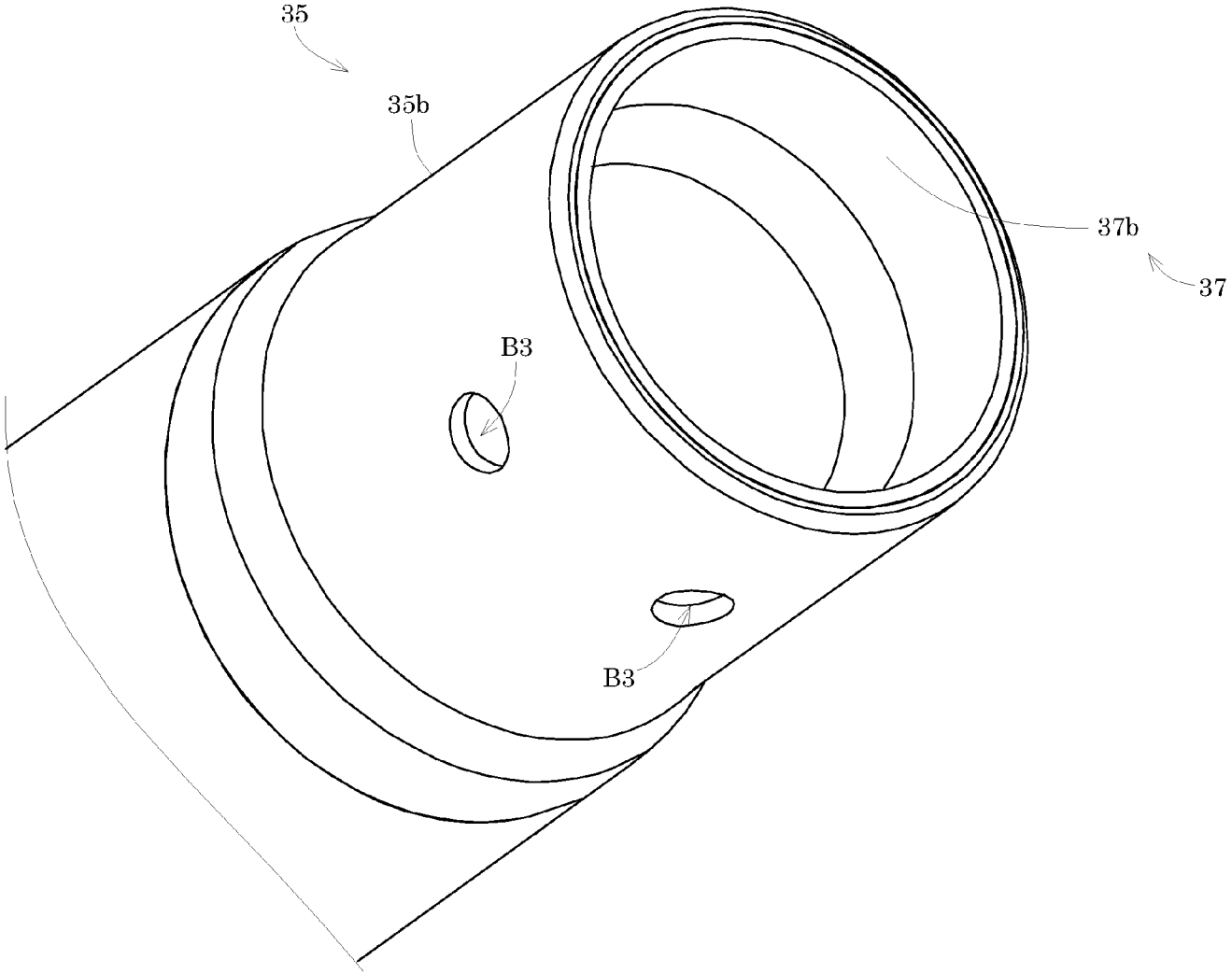
FIG. 5 is an enlarged perspective view of a downstream end of an outer pipe.
Figure 6:
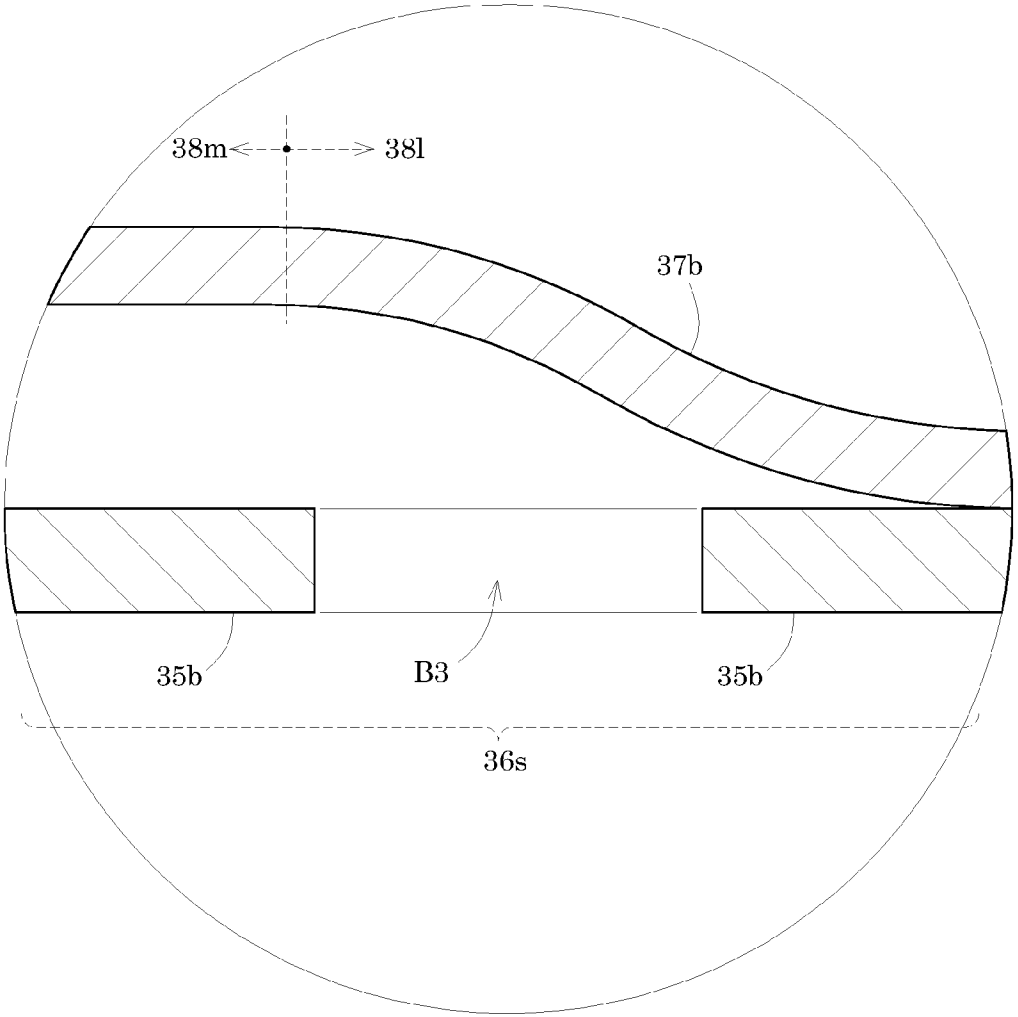
FIG. 6 is a detailed sectional view of a third through-hole.

Reference is made to FIGS. 5 and 6. FIG. 5 is an enlarged perspective view of the downstream end of the outer pipe 35, and FIG. 6 is a detailed sectional view of a third through-hole. As shown in FIG. 5, the third through-holes B3 are in a plural number, and are arranged circumferentially.

As shown in FIG. 6, the third through-holes B3 are arranged close to where the outer pipe 35 and inner pipe 37 join together in a gas-tight state. The third through-holes B3 are arranged in positions opposed to the large diameter portion 381 of the inner pipe 37. More particularly, the third through-holes B3 are arranged in positions overlapping the large diameter portion 381 of the inner pipe 37 with respect to the direction of the central axis P (see FIG. 3) of the outer pipe 35. The third through-holes B3 correspond to the third through-holes, and correspond also to the drain holes according to a preferred embodiment of the present invention.

Surface treatment of the above exhaust pipe 11 will be described briefly by way of example. Surface treatment is carried out for the exhaust pipe 11 in a state where, as shown in FIG. 2, the outer pipe 35 and inner pipe 37 have been formed and shaped, the first through-hole B1, second through-hole B-2 and third through-holes B3 have been formed, and the boss member 41 has been attached. In the surface treatment, the exhaust pipe 11 is treated sequentially in a degreasing treatment tank, a cleaning treatment tank, a nickel plating treatment tank and a chrome plating treatment tank storing predetermined treating liquids for surface treatment (hereinafter referred to as the "treating liquids"), respectively.

Specifically, the exhaust pipe 11 is suspended and transported by a jig to be immersed in each treating tank for a predetermined time. At this time, the treating liquid flows into the space A through the second through-hole B2 and third through-holes B3. After lapse of the predetermined time, the exhaust pipe 11 is withdrawn up from the treating tank. When withdrawn up, the treating liquid having flowed into the space A is promptly discharged through the third through-holes B3. And when the treating liquid is thoroughly drained from the exhaust pipe 11, it is transported to and immersed in the next treating tank. The timing for carrying out this surface treatment corresponds to the "time of manufacturing the exhaust pipe" according to a preferred embodiment of the present invention.

Figure 7:
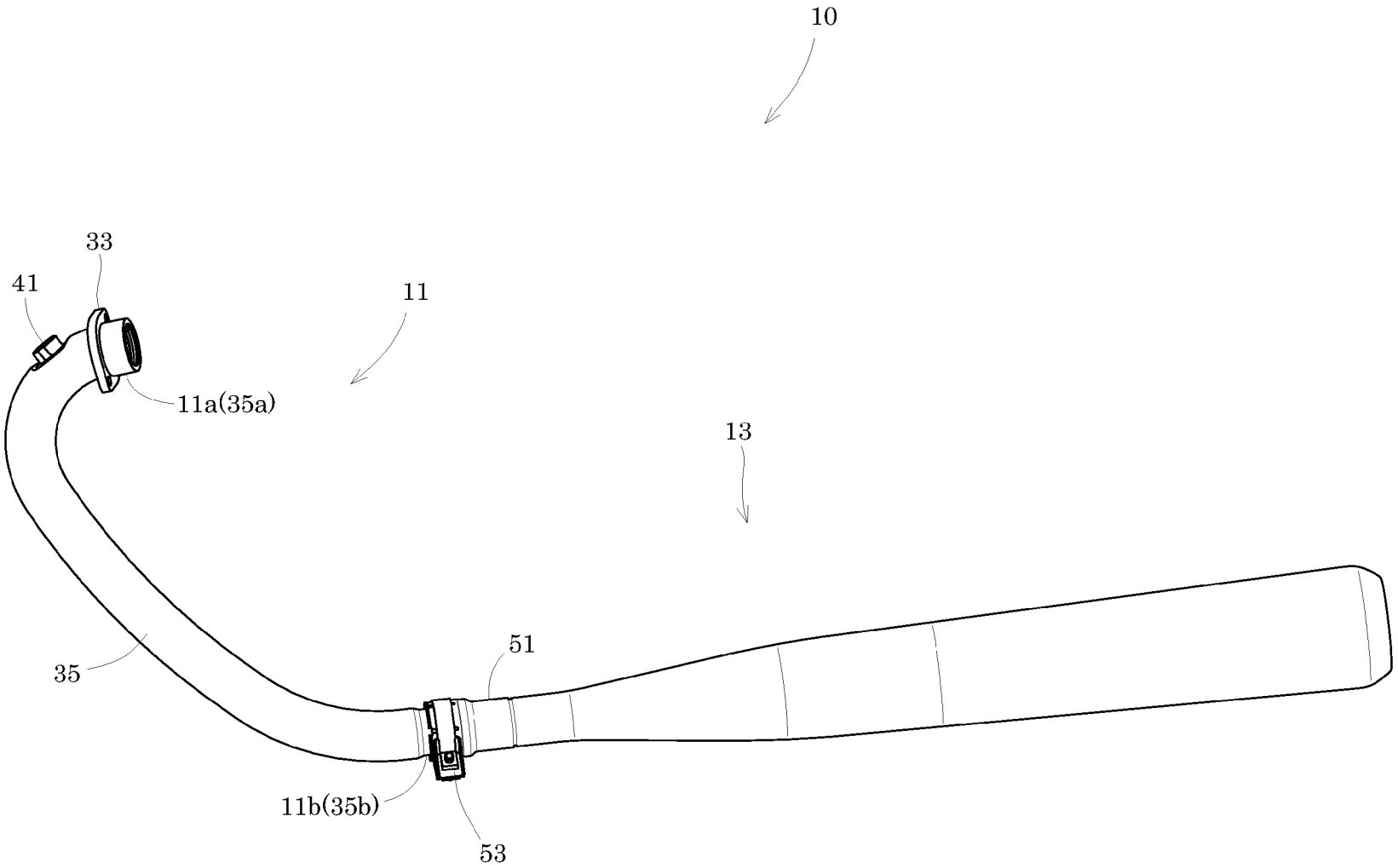
FIG. 7 is a perspective view of a joined state of the exhaust pipe and a muffler.
Figure 8:
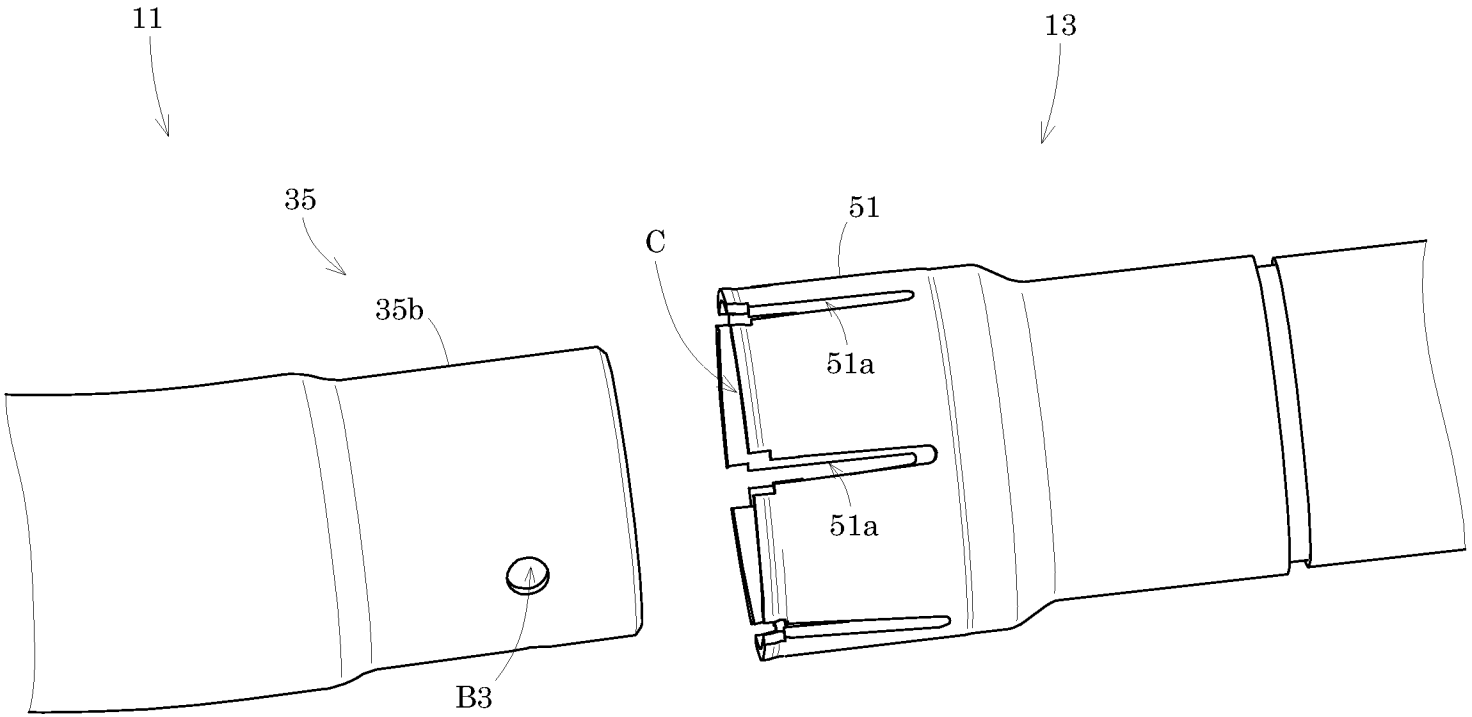
FIG. 8 is a detailed view of a downstream end of the exhaust pipe and a fitting portion of the muffler.
Figure 9:
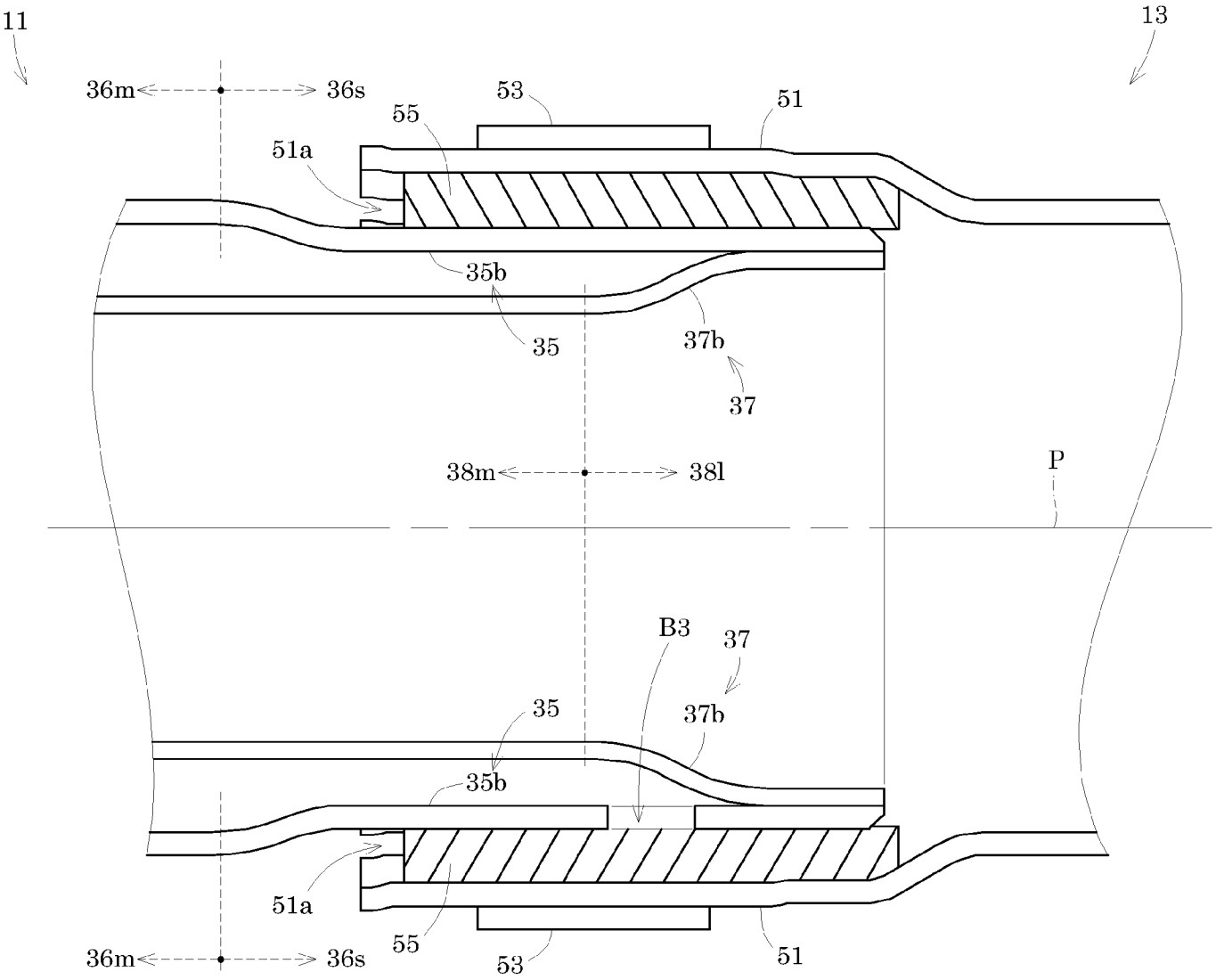
FIG. 9 is a detailed sectional view of a joint of the exhaust pipe and muffler.

FIG. 7 is a perspective view of a joined state of the exhaust pipe and muffler. FIG. 8 is a detailed view of the downstream end of the exhaust pipe and a fitting portion of the muffler. FIG. 9 is a detailed sectional view of a joint of the exhaust pipe and muffler. The exhaust pipe 11 is installed after the above surface treatment is carried out.

As shown in FIG. 7, the exhaust pipe 11 is inserted in the muffler 13. Specifically, the end 11*b* of the exhaust pipe 11 (the end 35*b* of the outer pipe 35) is inserted in the interior of a fitting portion 51 provided at an upstream end of the muffler 13. Consequently, the third through-holes B3 also are inserted in the interior of the fitting portion 51. This fitting portion 51 is tightened from outside by a band member 53 of the fitting portion.

This will be described in greater detail with reference to FIGS. 8 and 9. The fitting portion 51 has an opening C slightly larger than the outside diameter of the end 35*b* of the outer pipe 35. Slits 51*a* are formed in a peripheral surface of the fitting portion 51.

When the end 35*b* of the outer pipe 35 is inserted in the opening C of this fitting portion 51, the end 35*b* of the outer pipe 35 including the third through-holes B3 is covered by the fitting portion 51. Further, a gasket 55 which seals the third through-holes B3 is mounted between the end 35*b* of the outer pipe 35 and the fitting portion 51, and fixed by the fitting portion 51. The third through-holes B3 are covered by this gasket 55.

Preferably, the gasket 55 has elasticity. In other words, the gasket 55 preferably is in the form of an elastic body. As a procedure of attaching the gasket 55, before inserting the end 35*b* of the outer pipe 35, the gasket 55 may be attached to the end 35*b* of the outer pipe 35 so as to cover the third through-holes B3 beforehand, and thereafter the outer pipe 35 may be fitted in the fitting portion 51. Or before inserting the end 35*b* of the outer pipe 35, the gasket 55 may be attached to the inner peripheral surface of the fitting portion 51 beforehand, and thereafter the outer pipe 35 may be fitted in the fitting portion 51.

The range covered by the gasket 55 may be the entirety of the end 35*b* of the outer pipe 35, or may be a portion of the end 35*b* including at least the third through-holes B3. The gasket 55 corresponds to the seal member according to a preferred embodiment of the present invention.

Then, the fitting portion 51 is tightened with the fitting portion's band member 53. It is preferred that the fitting portion's band member 53 is disposed in a position at least corresponding to the third through-holes B3.

Consequently, the fitting portion 51 fixes the gasket 55 in a state of directly pressing the gasket 55 on the outer surface of the outer pipe 35, whereby the gasket 55 is in close contact with the third through-holes B3. Where the gasket 55 has elasticity, the gasket 55 elastically deforms to fit flexibly to the edges of the third through-holes B3, to secure a further improved sealing action. Consequently, the third through-holes B3 are sealed, and the exhaust pipe 11 and muffler 13 are connected in a gas-tight state.

The band member 53 of the fitting portion and gasket 55, together with the exhaust pipe 11 and muffler 13, constitute the exhaust system 10. The muffler 13 corresponds to the exhaust system member (particularly the exhaust system member connected downstream of the exhaust pipe) according to a preferred embodiment of the present invention. The fitting portion 51, which is part of the muffler 13, corresponds also to the fixing member according to a preferred embodiment of the present invention.

Next, the flow of exhaust gas in the exhaust pipe 11 according to Preferred Embodiment 1 will be described.

Reference is made to FIG. 10. FIG. 10 is a sectional view of the exhaust system schematically showing a flowing direction of exhaust gas. Exhaust gas discharged from the engine 5 flows into the end 37*a* of the inner pipe 37 of the exhaust pipe 11. Most of the exhaust gas having flowed into the inner pipe 37 moves toward the end 37*b* of the inner pipe 37. And the gas flows out of the end 37*b* of the inner pipe 37 into the muffler 13. A portion of the exhaust gas having flowed into the inner pipe 37 flows into the space A through the gap between the second through-hole B2 and boss member 41. However, since the third through-holes B3 are sealed with the gasket 55, the exhaust gas having flowed into the space A does not leak out of the exhaust pipe 11. Therefore, the exhaust gas having flowed into the space A just stagnates therein, and no further exhaust gas flows into the space A.

Thus, with the exhaust system 10 according to Preferred Embodiment 1, since the third through-holes B3 are formed in the outer pipe 35, the treating liquids can be drained promptly from the space A at the time of surface treatment of the exhaust pipe 11 such that productivity of the exhaust pipe 11 is never lowered. The third through-holes B3 are sealed after the treating liquids are drained. Thus, even if exhaust gas flows into the space A through the second through-hole B2, the exhaust gas can be prevented from being discharged to the atmosphere.

Since the third through-holes B3 are arranged at the end 35*b* of the outer pipe 35, the third through-holes B3 are sealed by inserting the end 35*b* of the outer pipe 35 including the third through-holes B3 in the opening of the muffler 13 (that is, the opening C of the fitting portion 51). Therefore, the third through-holes B3 can be sealed through an operation to attach the exhaust pipe 11 to the muffler 13, and the working efficiency in installing the exhaust pipe 11 is never lowered.

Since the third through-holes B3 are arranged in the small diameter portion 36*s*, the fitting portion 51 of the muffler 13 can easily cover the third through-holes B3 to seal the third through-holes B3 conveniently.

The outer pipe 35 and inner pipe 37 are joined adjacent the third through-holes B3 to block the space A. Thus, the treating liquids can be drained reliably from the space A through the third through-holes B3. The third through-holes B3 are arranged at the position of the outer pipe 35 which overlaps the large diameter portion 381 of the inner pipe 37 in the direction of the central axis P of the outer pipe 35. This can prevent the liquids from remaining in the space A when draining the liquids from the space A between the outer pipe 35 and inner pipe 37 through the third through-holes B3.

The boss member 41 provided allows exhaust gas detector 40 to penetrate the outer pipe 35 in a gas-tight state. The gap between the boss member 41 and outer pipe 35 is sealed by welding, which can conveniently prevent the exhaust gas from being discharged to the atmosphere through the first through-hole B1.

Since the gasket 55 is fixed by the fitting portion 51 and band member 53 of the fitting portion, the third through-holes B3 can be sealed reliably without being influenced by vibration and the like. Further, the fitting portion 51 and band member 53 press the gasket 55 on the outer surface of the outer pipe 35, which can conveniently place the gasket 55 in close contact with the third through-holes B3.

With the fitting portion 51 and band member 53, the exhaust pipe 11 and muffler 13 are connected, and at the same time sealing of the third through-holes B3 and fixation of the gasket 55 is achieved. Thus, the working efficiency in installing the exhaust pipe 11 is never lowered.

With the two-wheeled motor vehicle 1 according to Preferred Embodiment 1, exhaust gas can be prevented from being discharged from the exhaust pipe 11 to the atmosphere without lowering productivity of the exhaust pipe 11 and the working efficiency in installing the exhaust pipe 11.

Second Preferred Embodiment

Next, Preferred Embodiment 2 of the present invention will be described with reference to the drawings. Since the construction of a two-wheeled motor vehicle 1 in Preferred Embodiment 2 is substantially the same as in Preferred Embodiment 1, the construction of the two-wheeled motor vehicle 1 according to Preferred Embodiment 2 will not be described. Components identical to those of Preferred Embodiment 1 are shown with the same signs, and will not particularly be described.

Figure 11:
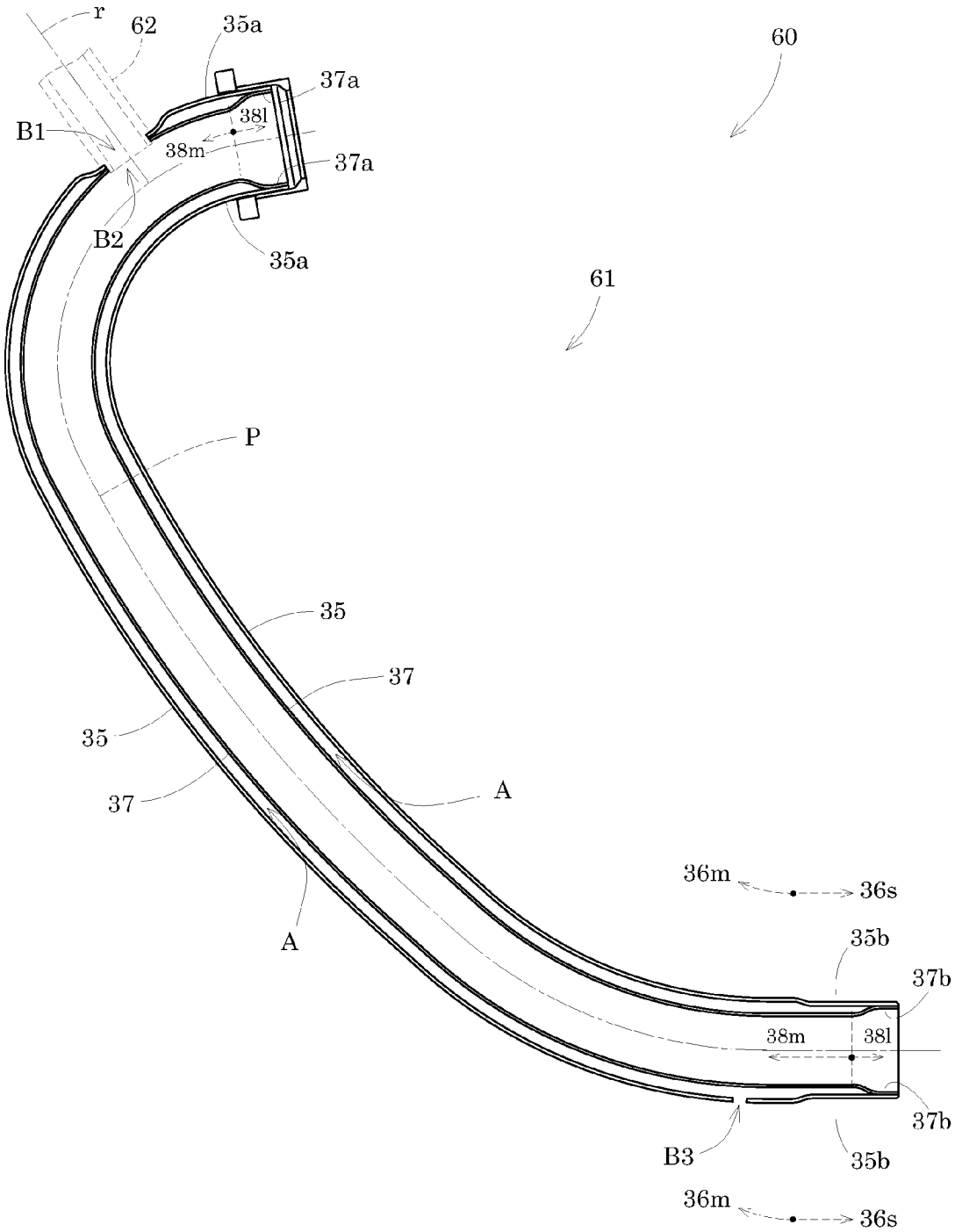
FIG. 11 is a sectional view of an exhaust system according to Preferred Embodiment 2 of the present invention.
Figure 12:
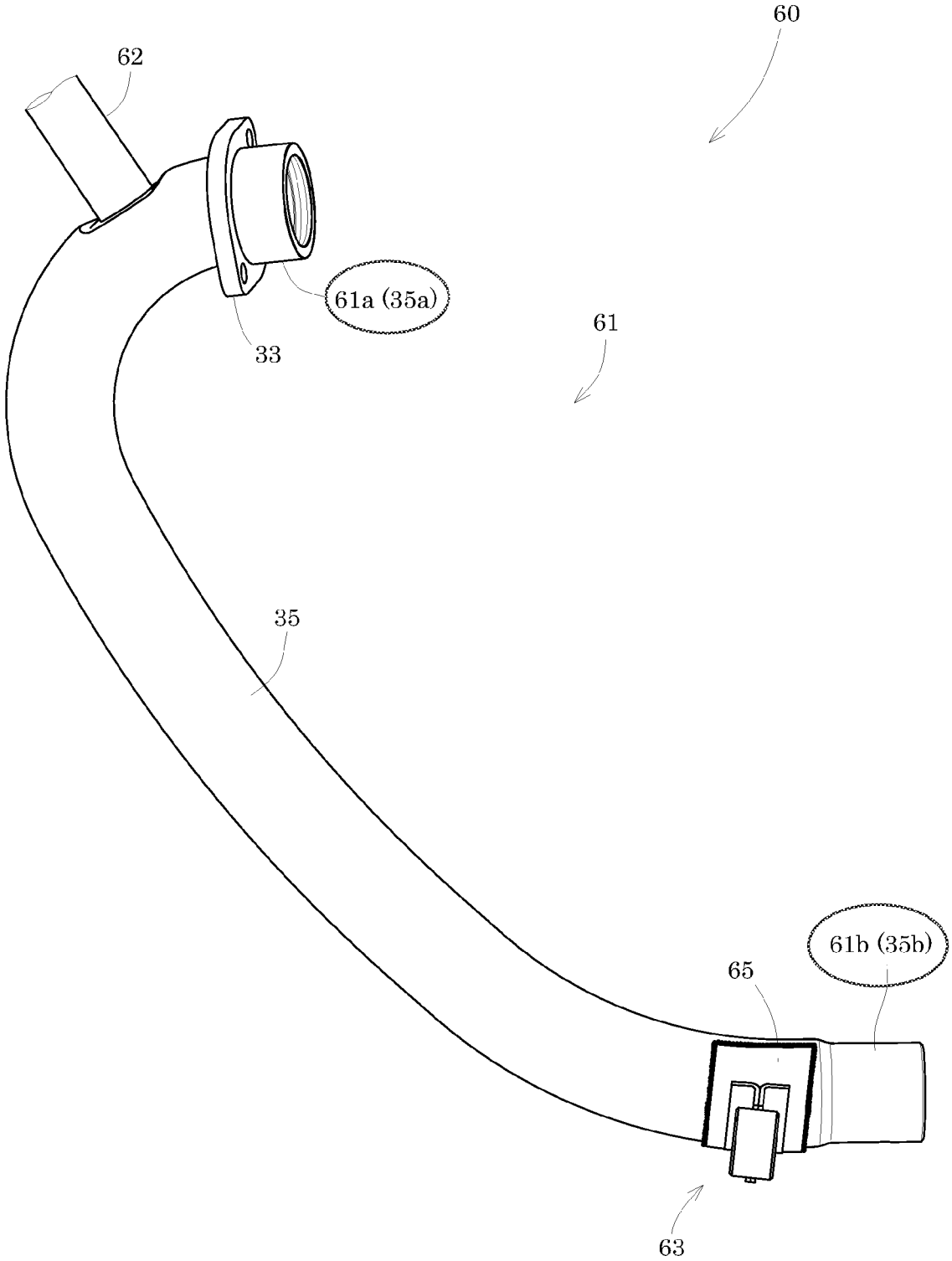
FIG. 12 is an appearance perspective view of the exhaust system according to Preferred Embodiment 2 of the present invention.

FIG. 11 is a sectional view of an exhaust system according to Preferred Embodiment 2. FIG. 12 is an appearance perspective view of the exhaust system according to Preferred Embodiment 2. An exhaust system 60 according to Preferred Embodiment 2 includes an exhaust pipe 61. An upstream end 61*a* of the exhaust pipe 61 is connected to the engine 5. A downstream end 61*b* of the exhaust pipe 61 is connected to the muffler 13. This exhaust pipe 61 has the outer pipe 35 and inner pipe 37. The first through-hole B1 and second through-hole B2 receive a branch piping member 62 inserted from outside the outer pipe 35 into the inner pipe 37. The branch piping member 62 is fixed directly to the outer pipe 35. That is, the boss member 41 described in Preferred Embodiment 1 is not provided for the exhaust pipe 61 according to Preferred Embodiment 2. The branch piping member 62 has an outer peripheral surface thereof welded over an entire circumference to the edge of the first through-hole B1 in a gas-tight state, whereby a gap between the branch piping member 62 and outer pipe 35 is sealed.

The branch piping member 62 may, for example, be a secondary air feed pipe to feed secondary air to the exhaust pipe 61, or a recirculating pipe to recirculate the exhaust gas in the exhaust pipe 61 to an inlet pipe (not shown) of the engine 5. The branch piping member 62 corresponds to the insert member according to a preferred embodiment of the present invention.

The third through-holes B3 are not arranged at the end 35*b* of the outer pipe 35, but are arranged in a position slightly shifted from the end 35*b* toward the middle. This position of the third through-holes B3 is in the main body portion 36*m*, and not in the small diameter portion 36*s*.

Surface treatment of this exhaust pipe 61 is carried out for the exhaust pipe 61 in a state where, as shown in FIGS. 11 and 12, the outer pipe 35 and inner pipe 37 have been provided and shaped, and the first through-hole B1, second through-hole B-2 and third through-holes B3 have been provided. At this time, the third through-holes B3 are used to drain the treating liquids for the surface treatment from the space A.

Reference is made to FIG. 12. The exhaust pipe 61 includes a bracket member 63 attached to the outer pipe 35. The bracket member 63 is attached to the outer pipe 35 after a series of surface treatments. The bracket member 63 is a member connected to the main frame 3 or the like for supporting the exhaust pipe 61. This bracket member 63 includes a reinforcing plate 65 fixed to the outer surface of the outer pipe 35. This reinforcing plate 65 is placed on the outer surface of the outer pipe 35 to cover the third through-holes B3, and the entire circumference of the reinforcing plate 65 is fixed by welding to the outer pipe 35. Consequently, the third through-holes B3 are covered and sealed with the reinforcing plate 65 in a gas-tight state. The reinforcing plate 65 which is part of the bracket member 63 corresponds also to the seal member according to a preferred embodiment of the present invention.

Thus, with the exhaust system 60 according to Preferred Embodiment 2, the third through-holes B3 are sealed by attaching the bracket member 63 to the outer pipe 35, thereby preventing lowering of the productivity of the exhaust pipe 61.

Since the third through-holes B3 are sealed with the reinforcing plate 65, the third through-holes B3 can be sealed firmly without being influenced by vibration and shocks. Further, since the reinforcing plate 65 is fixed by welding, it is possible to dispense with a member such as the fitting portion's band member 53 described in Preferred Embodiment 1.

Since it is the bracket member 63 that seals the third through-holes B3, the timing for sealing the third through-holes B3 is not limited to the time of connecting the exhaust pipe 11 to the muffler 13 as in Preferred Embodiment 1, but an arbitrary point in time can be selected. Consequently, a gas-tight test may be carried out before attaching the exhaust pipe 61, to check whether the third through-holes B3 are sealed.

The present invention is not limited to the foregoing preferred embodiments, but may be modified as described below.

In Preferred Embodiment 1 described above, the third through-holes B3 are preferably sealed with the gasket 55, but this is not limiting. For example, the gasket 55 may be changed to ceramic fiber, glass fiber, a heat insulating material, or a heat-resistant resin such as phenol resin. Or the third through-holes B3 may be sealed with a combination of two or more of these materials.

In Preferred Embodiment 1 described above, the fitting portion 51 in which the end 35*b* of the outer pipe 35 is inserted is preferably tightened by the band member 53 of the fitting member, but this is not limiting. For example, a fitting portion without slits may be formed at the upstream end of the muffler 13, and the end 35*b* of the outer pipe 35 may be pressed, along with the gasket 55, into the opening of this fitting portion. This modification can dispense with the band member 53. A fitting portion without slits may be formed at the upstream end of the muffler 13, the end 35*b* of the outer pipe 35 may be inserted in the opening of this fitting portion, and the forward end of the fitting portion may be welded over the entire circumference to the outer surface of the outer pipe 35 in a gas-tight state. This modification also can dispense with the band member 53.

In Preferred Embodiment 2 described above, the third through-holes B3 are preferably sealed with the bracket member 63, but this is not limiting. For example, a metal plate-shaped object may be provided exclusively for sealing the third through-holes B3. Specifically, a metal plate-shaped object may be placed to cover the third through-holes B3, and fixed by welding to the outer pipe 35 in a gas-tight state.

Or a gasket and a band member of a gasket may be provided, with the band member tightening the gasket disposed to cover the third through-holes B3. The band member of the gasket corresponds to the sealing band member in a preferred embodiment of the present invention.

In each preferred embodiment described above, the gasket 55 or reinforcing plate 65 is preferably fixed to the outer surface of the outer pipe 35, but this is not limiting. For example, this may be modified to seal the third through-holes B3 by inserting gaskets or ceramic bodies in the third through-holes B3.

In Preferred Embodiment 1 described above, the third through-holes B3 are sealed preferably by connecting the exhaust pipe 11 to the muffler 13, but this is not limiting. This may be modified such that, where, for example, the exhaust pipe 11 is directly connected to a catalytic converter or to another exhaust pipe distinct from the exhaust pipe 11, the third through-holes B3 are sealed by connecting the exhaust pipe 11 to the catalytic converter or other pipe.

In Preferred Embodiment 1 described above, the third through-holes B3 are arranged at the end 35*b* of the outer pipe 35, but this is not limiting. For example, the third through-holes B3 may be arranged at the upstream end 35*a* of the outer pipe 35. The third through-holes B3 may be arranged at both the upstream end 35*a* and downstream end 35*b* of the outer pipe 35. Where the third through-holes B3 are arranged at the end 35*a* of outer pipe 35, the third through-holes B3 may be sealed at the end 35*a* of the outer pipe 35 by connecting the exhaust pipe 11 to an exhaust system member provided upstream of the exhaust pipe 11. The exhaust system member directly connected to the upstream end of the exhaust pipe 11 may, for example, be the engine 5, a catalytic converter, or another exhaust pipe distinct from the exhaust pipe 11.

In each preferred embodiment described above, surface treatment is preferably carried out for the exhaust pipe 11, 61, but this is not limiting. The third through-holes B3 are not limited to the function for draining the treating liquids for the surface treatment from the space A. That is, preferred embodiments of the present invention are applicable also where surface treatment is not carried out for the exhaust pipe 11, 61. There is a case, for example, where a process is carried out to bend the outer pipe 35 and inner pipe 37 with a filler (liquid) filling and frozen in the space A (which is a bending process called "ice bending"). After the bending process, the filler after being thawed (i.e., liquid) is drained from the space A. Thus, the third through-holes B3 may be formed in order to drain the liquid filled and frozen at the time of bending. The third through-holes B3 may serve to drain both the treating liquids for surface treatment and the liquid filled and frozen at the time of bending. The time of bending corresponds to the "time of manufacturing the exhaust pipe" according to a preferred embodiment of the present invention.

In each preferred embodiment described above, the shape of the third through-holes B3 may be selected and varied as appropriate. The number of third through-holes B3 may be single or may be plural.

In each preferred embodiment described above, the first through-hole B1 and second through-hole B2 preferably are each single, but this is not limiting. That is, the first through-hole B1 and second through-hole B2 may each be plural. In Preferred Embodiment 1, the exhaust gas detector 40 is preferably single, but preferred embodiments of the present invention are applicable also where a plurality of exhaust gas detectors 40 are provided for the exhaust pipe 11. Similarly, the branch piping member 62 is single in Preferred Embodiment 2, but the present invention is applicable also where a plurality of branch piping members 62 are connected to the exhaust pipe 61. Further, preferred embodiments of the present invention are applicable also where both the exhaust gas detector 40 and branch piping member 62 are attached to the exhaust pipe 11, 61.

Preferred Embodiment 1 described above preferably provides the boss member 41 arranged to attach the exhaust gas detector 40, but this is not limiting. A modification may be made according to the structure of exhaust gas detector 40, to attach the exhaust gas detector 40 directly to the outer pipe 35, and the boss member 41 may be omitted.

In Preferred Embodiment 2 described above, the branch piping member 62 preferably is directly inserted in the first through-hole B1 and second through-hole B2, but this is not limiting. A modification may be made to provide a mounting member disposed in the first through-hole B1 for attaching the branch piping member 62 to the outer pipe 35.

The construction of exhaust system 10, 60 and the shape of exhaust pipe 11, 61 described in each of the foregoing preferred embodiments may be varied as appropriate. The exhaust pipe 11 in each preferred embodiment, for example, includes the single upstream end 11*a* and single downstream end 11*b*, but this is not limiting.

Figure 13:
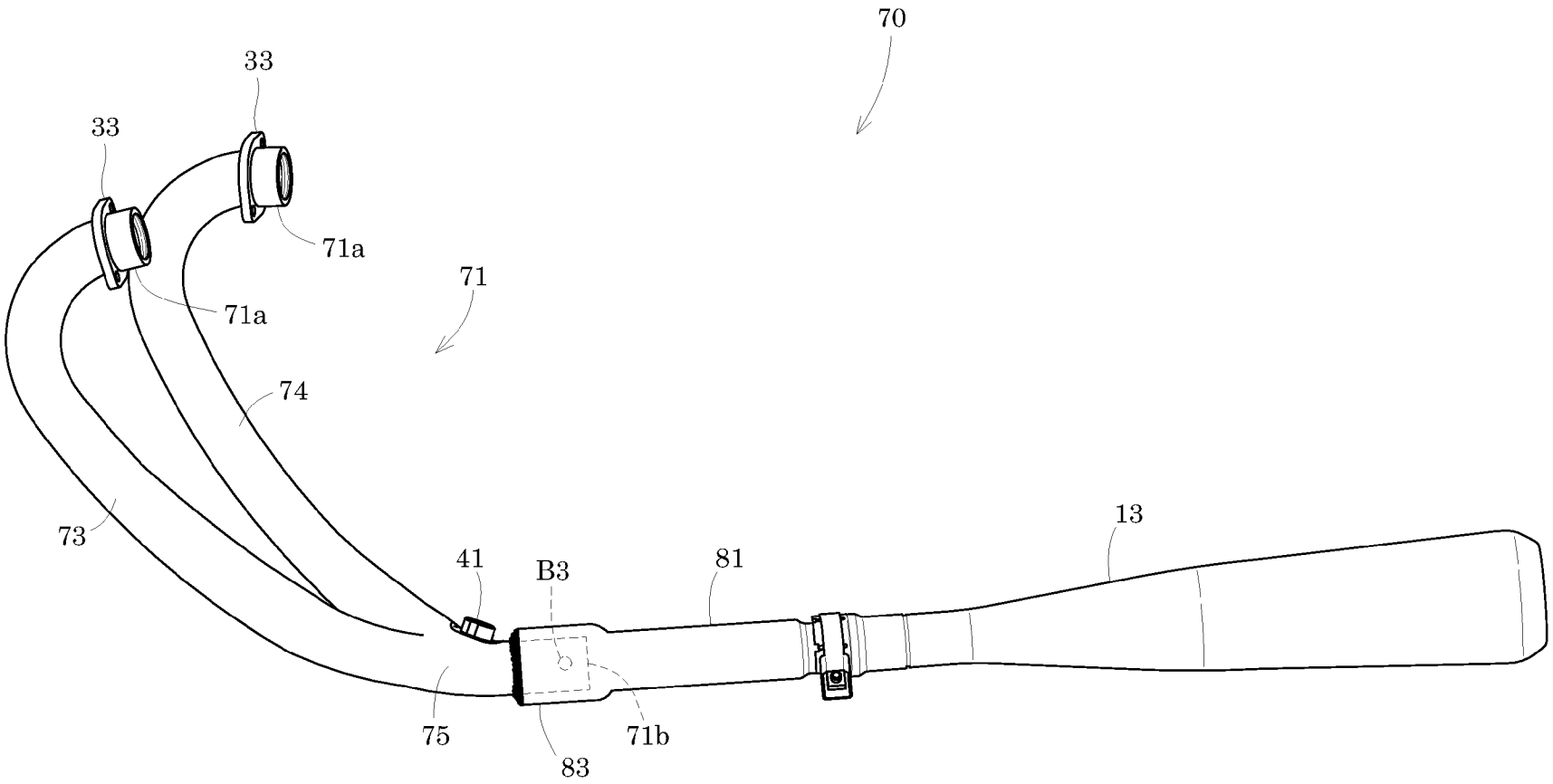
FIG. 13 is an appearance perspective view of an exhaust system according to a modified preferred embodiment of the present invention.

FIG. 13 is an appearance perspective view of an exhaust system 70 according to a modified preferred embodiment. The exhaust system 70 includes an exhaust pipe 71, another exhaust pipe 81 distinct from the exhaust pipe 71, and a muffler 13. The exhaust pipe 71 is what is called a manifold, and includes a plurality of (two) branch pipes 73 and 74, and a collecting pipe 75 which collects these branch pipes 73 and 74. That is, the exhaust pipe 71 includes a plurality of (two) upstream ends 71*a* and a single downstream end 71*b*. Although not shown, the exhaust pipe 71 includes a double structure including an outer pipe and an inner pipe.

A boss member 41 is fixed to the middle of the collecting pipe 75. The boss member 41 is inserted in a first through-hole B1 and a second through-hole B2 not shown. Third through-holes B3 are provided at the end 71*b* of the exhaust pipe 71.

The other exhaust pipe 81 distinct from the exhaust pipe 71 is connected downstream of the exhaust pipe 71. Specifically, a fitting portion 83 is provided at the upstream end of the other exhaust pipe 81, and the end 71*b* of exhaust pipe 71 is inserted in this fitting portion 83. The third through-holes B3 are covered with the fitting portion 83. The forward end of the fitting portion 83 is fixed by welding over the entire circumference to the outer surface of the exhaust pipe 71. Consequently, the exhaust pipe 71 is connected to the other exhaust pipes 81, and the third through-holes B3 are sealed.

The muffler 13 is connected downstream of the other exhaust pipe 81. The other, distinct exhaust pipe 81, along with the muffler 13, corresponds to the exhaust system member according to a preferred embodiment of the present invention.

Thus, preferred embodiments of the present invention are applicable also where the exhaust pipe 71 has a plurality of upstream ends 71*a*. Therefore, it is conveniently applicable also where the engine 5 has multiple cylinders. Similarly, although not shown, the present invention is applicable also where the exhaust pipe has a plurality of downstream ends.

In each preferred embodiment, the first through-hole B1 preferably is provided in the outer pipe 35, but this is not limiting. For example, only the second through-hole B2 and third through-holes B3 may be formed without forming the first through-hole B1. In this case also, the liquids can be drained promptly from the space A through the third through-holes B3 at a time of manufacture. Subsequently, the third through-holes B3 may be sealed to prevent the exhaust gas from being discharged to the atmosphere.

Figure 14:
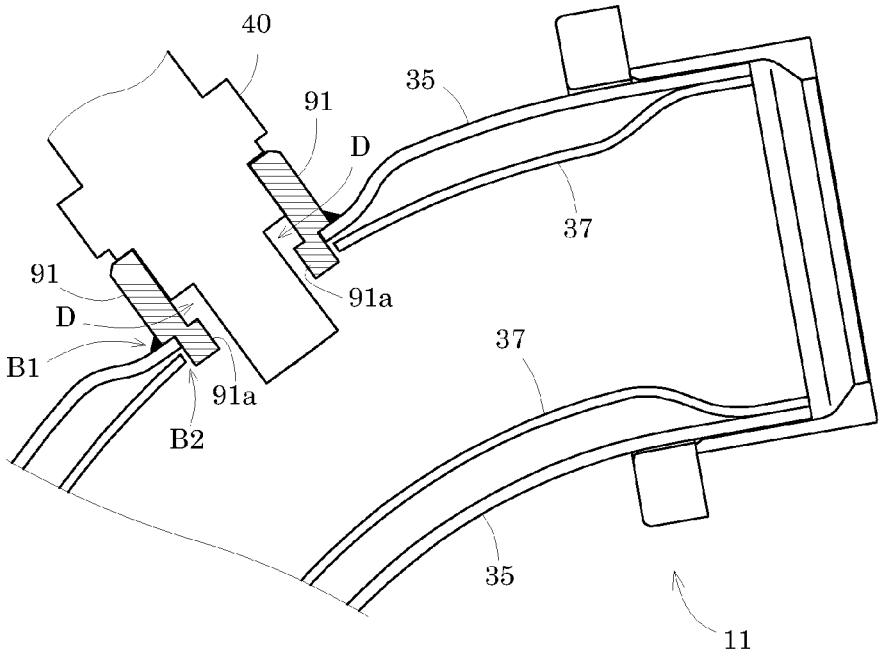
FIG. 14 is a detailed sectional view of a boss member according to a modified preferred embodiment of the present invention.

In Preferred Embodiment 1, the boss member 41 used preferably includes an inner circumference fixed in the axial direction thereof, but this is not limiting. Reference is made to FIG. 14. FIG. 14 is a detailed sectional view of a boss member according to a modified preferred embodiment. As shown, a boss member 91 according to the modified preferred embodiment has a level difference in the inner peripheral surface thereof. Specifically, the boss member 91 has an annular projection 91*a* which projects inward at the forward end of the boss member 91. This projection 91*a* can diminish the gap between the forward end of the boss member 91 and gas detector 40, thereby to prevent the exhaust gas from the engine 5 flowing into a space D formed between the inner peripheral surface of the boss member 91 and the gas detector 40. Since the temperature of this space D is prevented from rising to excess, the heat-resistant structure can be simplified. The boss member 91 corresponds to the mounting member according to a preferred embodiment of the present invention.

Figure 15:
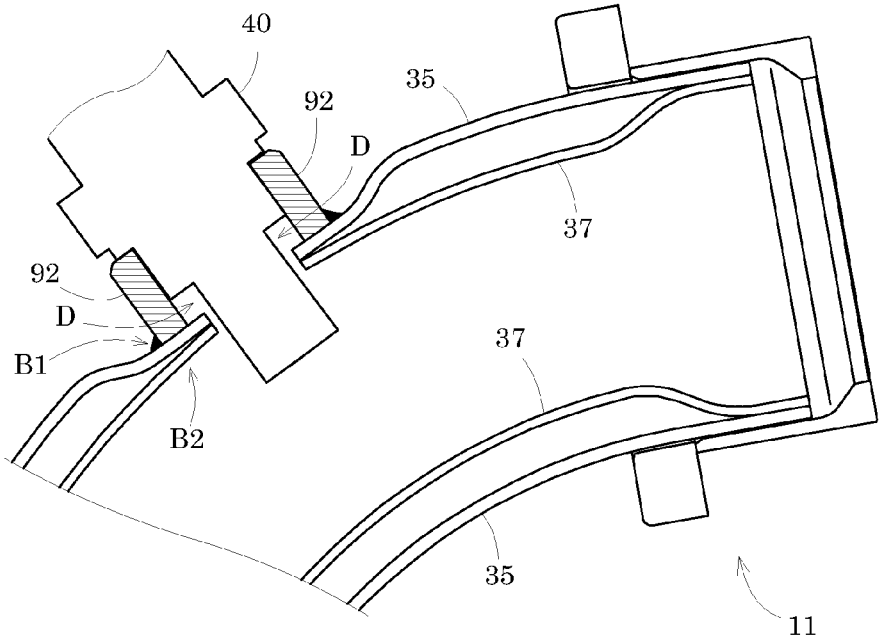
FIG. 15 is a detailed sectional view of a boss member according to a modified preferred embodiment.

Reference is made to FIG. 15. FIG. 15 is a detailed sectional view of a boss member according to a modified preferred embodiment. As shown, a boss member 92 according to the modified preferred embodiment is not inserted in the first through-hole B1, but the forward end of the boss member 92 is fixed by welding in a state of contacting the outer surface of the outer pipe 35. Since the boss member 92 is fixed to the outer pipe 35 in this way, the diameter of the first through-hole B1 has a value selected to be slightly larger than the outside diameter of the gas detector 40, and smaller than the diameter of the inner peripheral surface of the boss member 92. As a result, the gap between the edge of the first through-hole B1 and the gas detector 40 can be diminished, thereby to prevent the exhaust gas from the engine 5 flowing into a space D formed between the inner peripheral surface of the boss member 92 and the gas detector 40. Thus, the same effect as the construction having the above boss member 91 can be achieved. Further, it is preferable in this case that the diameter of the second through-hole B2 is substantially the same as the diameter of the first through-hole B1. This can prevent, with increased reliability, the exhaust gas from the engine 5 flowing into the space D. The boss member 92 corresponds to the mounting member according to a preferred embodiment of the present invention.

In each preferred embodiment, the exhaust pipe 11 preferably includes the outer pipe 35 and inner pipe 37, but this is not limiting. For example, the exhaust pipe 11 may be modified to have piping disposed inside the inner pipe 37.

Each preferred embodiment described above preferably shows the two-wheeled motor vehicle 1 having the single front wheel 17 and single rear wheel 23 by way of example, but this is not limiting. It may, for example, be a saddle riding type vehicle with two front wheels or rear wheels, or a saddle riding type vehicle with two front wheels and two rear wheels.

Each preferred embodiment described above and each of the modified preferred embodiments described above may be varied as appropriate by replacing or combining each construction with the constructions of the other modified preferred embodiments.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An exhaust system for exhaust gas discharged from an engine, the exhaust system comprising:

an exhaust pipe including an inner pipe arranged to guide the exhaust gas and an outer pipe mounted outside of the inner pipe; wherein a first through-hole is provided in a peripheral surface of the outer pipe to receive an insert member inserted from outside the outer pipe into the inner pipe;

a second through-hole is provided in a peripheral surface of the inner pipe to receive the insert member;

third through-holes are provided in the peripheral surface of the outer pipe at a different position than that of the first through-hole; and when the exhaust system member is connected to the exhaust pipe, the third through-holes are arranged at a position inside of the exhaust system member.

2. The exhaust system according to claim 1, wherein the outer pipe includes a main body portion and a smaller diameter portion having a smaller outside diameter than the main body portion, the third through-holes being arranged in the smaller diameter portion.

3. The exhaust system according to claim 1, wherein the outer pipe and the inner pipe are joined adjacent the third through-holes to block a space between the outer pipe and the inner pipe.

4. The exhaust pipe system according to claim 1, wherein the inner pipe includes a main body portion and a larger diameter portion having a larger diameter than the main body portion, the third through-holes being arranged in the peripheral surface of the outer pipe, in a position which overlaps the larger diameter portion in a direction of a center axis of the outer pipe.

5. The exhaust system according to claim 1, further comprising a mounting member arranged to hold the insert member, wherein a gap between the mounting member and the outer pipe is sealed by a welded portion.

6. An exhaust system for exhaust gas discharged from an engine, the exhaust system comprising:

an exhaust pipe including an inner pipe arranged to guide the exhaust gas and an outer pipe mounted outside of the inner pipe; wherein a first through-hole is provided in a peripheral surface of the outer pipe to receive an insert member inserted from outside the outer pipe into the inner pipe;

a second through-hole is provided in a peripheral surface of the inner pipe to receive the insert member;

third through-holes are provided in the peripheral surface of the outer pipe at a different position than that of the first through-hole; and the exhaust system includes a seal member arranged to seal the third through-holes.

7. The exhaust system according to claim 6, wherein the seal member is elastic.

8. The exhaust system according to claim 6, wherein the seal member includes at least one of a gasket, ceramic fiber, glass fiber, a heat insulating material, or a heat-resistant resin.

9. The exhaust system according to claim 6, further comprising a fixing member arranged to fix the seal member, wherein the seal member is disposed on an outer surface of the outer pipe so as to cover the third through-holes.

10. The exhaust system according to claim 9, wherein the fixing member is arranged to press the seal member onto the outer surface of the outer pipe.

11. The exhaust system according to claim 9, further comprising:

an exhaust system member connected to the exhaust pipe, with an end of the exhaust pipe inserted therein; wherein the exhaust system member includes a fitting portion arranged to receive the end of the exhaust pipe fitted therein;

the third through-holes are arranged within the fitting portion; and the fixing member and the fitting portion are arranged to fix the seal member on the outer pipe.

12. The exhaust system according to claim 11, wherein the fixing member further includes a band member arranged to tighten the fitting portion to press the seal member.

13. A saddle riding type vehicle comprising:

an exhaust pipe including an inner pipe arranged to guide exhaust gas discharged from an engine and an outer pipe mounted outside of the inner pipe; wherein a first through-hole is provided in a peripheral surface of the outer pipe to receive an insert member inserted from outside the outer pipe into the inner pipe;

a second through-hole is provided in a peripheral surface of the inner pipe to receive the insert member;

third through-holes are provided in the peripheral surface of the outer pipe at a different position from that of the first through-hole; and when an exhaust system member is connected to the exhaust pipe, the third through-holes are arranged at a position inside of the exhaust system member.

14. A saddle riding type vehicle comprising:

an exhaust pipe including an inner pipe arranged to guide exhaust gas discharged from an engine and an outer pipe mounted outside of the inner pipe; wherein a first through-hole is provided in a peripheral surface of the outer pipe to receive an insert member inserted from outside the outer pipe into the inner pipe;

a second through-hole is provided in a peripheral surface of the inner pipe to receive the insert member;

third through-holes are provided in the peripheral surface of the outer pipe at a different position from that of the first through-hole; and the exhaust system includes a seal member arranged to seal the third through-holes.

* * * * *